US009437099B2

(12) United States Patent
Henderson et al.

(10) Patent No.: US 9,437,099 B2
(45) **Date of Patent: *Sep. 6, 2016**

(54) DETECTING PRESENCE USING A PRESENCE SENSOR NETWORK

(71) Applicant: AT&T Intellectual Property I, L.P., Atlanta, GA (US)

(72) Inventors: Donnie Henderson, Manalapan, NJ (US); Alicia Abella, Morristown, NJ (US); Gerald Michael Karam, Morristown, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/969,450

(22) Filed: Dec. 15, 2015

(65) Prior Publication Data

US 2016/0104365 A1 Apr. 14, 2016

Related U.S. Application Data

(63) Continuation of application No. 13/908,664, filed on Jun. 3, 2013, now Pat. No. 9,224,284.

(51) Int. Cl.
*G08B 13/00* (2006.01)
*G08B 21/22* (2006.01)

(52) U.S. Cl.
CPC ..... *G08B 21/22* (2013.01)

(58) Field of Classification Search
CPC ..... G08B 21/22
See application file for complete search history.

(56) References Cited

U.S. PATENT DOCUMENTS

| | | | |
|---|---|---|---|
| 5,627,517 | A | 5/1997 | Theimer et al. |
| 2010/0253521 | A1 | 10/2010 | Williams et al. |
| 2011/0027520 | A1 | 2/2011 | Lauterbach et al. |
| 2012/0195325 | A1 | 8/2012 | Connelly et al. |
| 2012/0268253 | A1 | 10/2012 | Tuttle |
| 2013/0092099 | A1 | 4/2013 | Hardi et al. |
| 2014/0188804 | A1 | 7/2014 | Gokhale et al. |

FOREIGN PATENT DOCUMENTS

| | | |
|---|---|---|
| WO | 2006039119 | 4/2006 |
| WO | 2006119412 | 11/2006 |

OTHER PUBLICATIONS

"NFC and RFID Reader Ultra-Low-Power Card Presence Detection Using MSP430 and TRF79xxA," Alexander Koritsky, et al., Mar. 2013. [retrieved from http://www.ti.com/general/docs/lit/getliterature.tsp?baseLiteratureNumber=sloa184].

(Continued)

*Primary Examiner* — Omeed Alizada
(74) *Attorney, Agent, or Firm* — Hartman & Citrin LLC

(57) ABSTRACT

Concepts and technologies are disclosed herein for detecting presence using a presence sensor network. In some embodiments, a computer executing a presence service generates a user interface for display at a user device. The user interface can include a control that, when selected, generates room data defining a monitored location. The computer can obtain sensor identifier data that identifies a presence sensor located at the monitored location and a location of the presence sensor at the monitored location. The computer can provide the user interface to the user device to obtain the room data and obtain the room data. The computer also can store the room data and the sensor identifier data.

20 Claims, 17 Drawing Sheets

(56) References Cited

OTHER PUBLICATIONS

"The Use of RFID for Human Identity Verification," Data Privacy & Integrity Advisory Committee, Report No. 2006-02, Dec. 6, 2006. [retrieved from http://www.dhs.gov/xlibrary/assets/privacy/privacy_advcom_12-2006_rpt_RFID.pdf].

"RFID-Enabled Presence Aware System (RPAS)," Nazleeni Samiha Haron, et al., Jan. 6, 2011. [retrieved from http://idosi.org/wasj/wasj12%28CA&Km%29/1.pdf].

U.S. Office Action dated Apr. 9, 2015 in U.S. Appl. No. 13/908,664.

U.S. Notice of Allowance dated Aug. 13, 2015 in U.S. Appl. No. 13/908,664.

DETECTING PRESENCE USING A PRESENCE SENSOR NETWORK

CROSS-REFERENCE TO RELATED APPLICATIONS

This application is a continuation of and claims priority to U.S. patent application Ser. No. 13/908,664 filed on Jun. 3, 2013, entitled "Detecting Presence Using a Presence Sensor Network," now U.S. Pat. No. 9,224,284, which is incorporated herein by reference in its entirety.

BACKGROUND

This application relates generally to detecting and using presence information. More specifically, the disclosure provided herein relates to detecting presence using a presence sensor network and using the presence to provide a presence service.

Presence sensors are used for a variety of purposes. For example, some rudimentary types of presence sensors are used in manufacturing to prevent bodily injury by machine operators; automatic doors to trigger opening and/or closing of the doors; garage door openers to reverse the garage door if a child, animal, or other object is detected in the path of the garage door; vehicles to provide object sensors around a periphery or elsewhere in the vicinity of the vehicles; or the like. With the proliferation of intelligent devices and automation of various operations that until recently were completed manually, the use of presence technologies has become valuable for power conservation efforts, user authentication, personal safety, and/or other purposes.

Presence sensors can operate using a variety of technologies such as, for example, optical technologies, infrared technologies, temperature-based technologies, switches and/or other hardware technologies such as pressure devices, sound detection technologies, sonar technologies, combinations thereof, or the like. Some presence sensors are expensive and therefore may be used sparingly and/or deployed only in carefully selected locations and/or devices.

To provide benefits of presence sensors in large areas or other locations where deploying presence sensors may be cost-prohibitive, cameras and/or other video technologies may be relied upon. Thus, for example, a store manager, owner, or other entity may view a video feed of a store or other location to determine if any action needs to be taken. For example, a manager may monitor video to watch an area around a cash register or other point-of-sale to determine if additional points-of-sale should be opened, to monitor performance, or the like. Video, however, requires attention and/or interpretation to become useful and therefore may provide little, if any, improvement over in-person monitoring. Additionally, some customers may be opposed to being videoed by storeowners or other entities.

SUMMARY

The present disclosure is directed to detecting presence using a presence sensor network. According to various embodiments of the concepts and technologies described herein, a monitored location can be determined and/or selected. A number of presence sensors can be located at the monitored location. As will be explained in more detail below, RFID tags can provide an inexpensive and effective presence sensor. According to some embodiments, data describing the monitored location can be configured and saved via interactions with a presence service or other presence application or module. The data can be saved in a memory, drive, database, or other data storage device. In some embodiments, the data includes room data describing the room, location, region, area, or other aspect of the monitored location; sensor ID data describing locations (within the monitored location) and identities of presence sensors located at the monitored location; trigger data defining alerts, alarms, or other notification conditions that, when determined to exist at that monitored location, trigger an alarm, alert, or other notification; other information such as trend information, historical information; or the like.

A presence service, other devices, or other modules can obtain presence data associated with the monitored location. The presence data can be provided by a computing system located at the monitored location. The presence data can be received by the presence service and used to determine presence at the monitored location. In some embodiments, the presence service compares the presence data to room data, sensor ID data, trigger data, other data, or the like, and determines the presence at the monitored location based upon this information. The presence service can generate presence display data that visually represents the determined presence, and also can trigger and/or generate alarms or alerts if determined to be appropriate based upon the determined presence. The presence display data can be provided to a user device, which can render one or more user interfaces for a user such as, for example, a manager, or the like. In some embodiments, a user device obtains and uses the presence data and generates the presence display data. Thus, the presence service can be omitted in some embodiments, or may not be accessed in some instances.

According to one aspect of the concepts and technologies disclosed herein, a method is disclosed. The method can include providing a user interface to a user device to obtain room data. The user interface can be displayed at the user device and can include a user interface control for inputting room data that defines a monitored location. The method also can include obtaining sensor identifier data that identifies a presence sensor at the monitored location. The sensor identifier data can include a unique identifier associated with the presence sensor data and data defining a location of a presence sensor at the monitored location. The method also can include the computer storing the room data defining the monitored location and the sensor identifier data.

In some embodiments, the method includes obtaining trigger data that defines an alarm condition. The alarm condition can trigger an alarm if the alarm condition is determined to exist at the monitored location. The method also can include obtaining presence data associated with the monitored location, the presence data including a unique identifier, and generating presence display data based upon the presence data, the room data, and the sensor identifier data. The presence data can be obtained via a receiver located at the monitored location, and the receiver can obtain the unique identifier from a radio frequency identification tag located at the monitored location.

In some embodiments, generating the presence display data can include analyzing the presence data, comparing the unique identifier to a list of identifiers included in the sensor identifier data, and determining that a person is located at a further presence sensor at the monitored location if a further unique identifier associated with the further presence sensor is not included in the presence data. The method also can include providing the presence display data to the user device, the presence display data including a web page. The method also can include, in some embodiments, sending an alert to the user device. The alert can include an indication that an alarm condition exists at the monitored location, and can be pushed to the user device, which can include a smartphone. The method also can include obtaining, from the user device, trigger data defining alarm conditions, and preferences defining how alerts are to be delivered to the user device. In some embodiments, the method also includes generating, at the computer, historical data defining presence at the monitored location, and trend data defining a trend associated with the presence at the monitored location. The presence sensor can include a radio frequency identification tag.

According to another aspect of the concepts and technologies disclosed herein, a system is disclosed. The system can include a processor and a memory. The memory can store computer-executable instructions that, when executed by the processor, cause the processor to perform operations including providing a user interface to a user device to obtain room data. The user interface can be displayed at the user device and can include a user interface control for inputting room data that defines a monitored location. The system also can obtain sensor identifier data that identifies a presence sensor at the monitored location. The sensor identifier data can include a unique identifier associated with the presence sensor data and data defining a location of a presence sensor at the monitored location. The system also can store the room data defining the monitored location and the sensor identifier data.

In some embodiments, the system can include a data store in communication with the server computer and a transceiver in communication with the presence sensor. In some embodiments, storing the room data and the sensor data can include storing the room data and the sensor data at the data store, and the presence data can be obtained by the transceiver, the transceiver comprising a radio frequency emitter and receiver. The presence sensor can include a radio frequency identification tag. In some implementations, presence sensor includes a floor tile that includes a substrate, a recess formed in the substrate, and a radio frequency identification tag disposed at the recess. In some embodiments, the recess is omitted from the floor tile.

In some embodiments, the system includes instructions that, when executed by the processor, cause the processor to perform operations further including obtaining trigger data defining an alarm condition that, if determined to exist at the monitored location, triggers an alarm, determining that the alarm condition exists, and sending an alert to the user device. The user device can include a smart phone, and sending the alert can include pushing the alert to the smart phone via a cellular network.

According to yet another aspect, a computer storage medium is disclosed. The computer storage medium can have computer-executable instructions stored thereon that, when executed by a processor, cause the processor to perform operations including providing a user interface to a user device to obtain room data. The user interface can be displayed at the user device and can include a user interface control for inputting room data that defines a monitored location. The storage medium also can include instructions that, when executed by the processor, cause the processor to obtain sensor identifier data that identifies a presence sensor at the monitored location. The sensor identifier data can include a unique identifier associated with the presence sensor data and data defining a location of a presence sensor at the monitored location. The instructions, when executed by the processor, can cause the processor to perform operations further comprising storing, by the computer, the room data defining the monitored location and the sensor identifier data.

In some embodiments, the instructions, when executed by the processor, cause the processor to perform operations further including obtaining presence data associated with the monitored location, the presence data including a unique identifier generated by a radio frequency identification tag, and generating presence display data based upon the presence data, the room data, and the sensor identifier data. In some embodiments, the instructions, when executed by the processor, cause the processor to perform operations further including obtaining data that defines an alarm condition, wherein the alarm condition triggers an alarm if the alarm condition is determined to exist at the monitored location, analyzing the presence data, and sending an alert to the user device, the alert including an indication that an alarm condition exists at the monitored location. In some embodiments, the instructions, when executed by the processor, cause the processor to perform operations further including generating, at the computer, historical data defining presence at the monitored location, and trend data defining a trend associated with the presence at the monitored location. The presence sensor can include a radio frequency identification tag.

Other systems, methods, and/or computer program products according to embodiments will be or become apparent to one with skill in the art upon review of the following drawings and detailed description. It is intended that all such additional systems, methods, and/or computer program products be included within this description, be within the scope of this disclosure.

DETAILED DESCRIPTION

Figure 1:
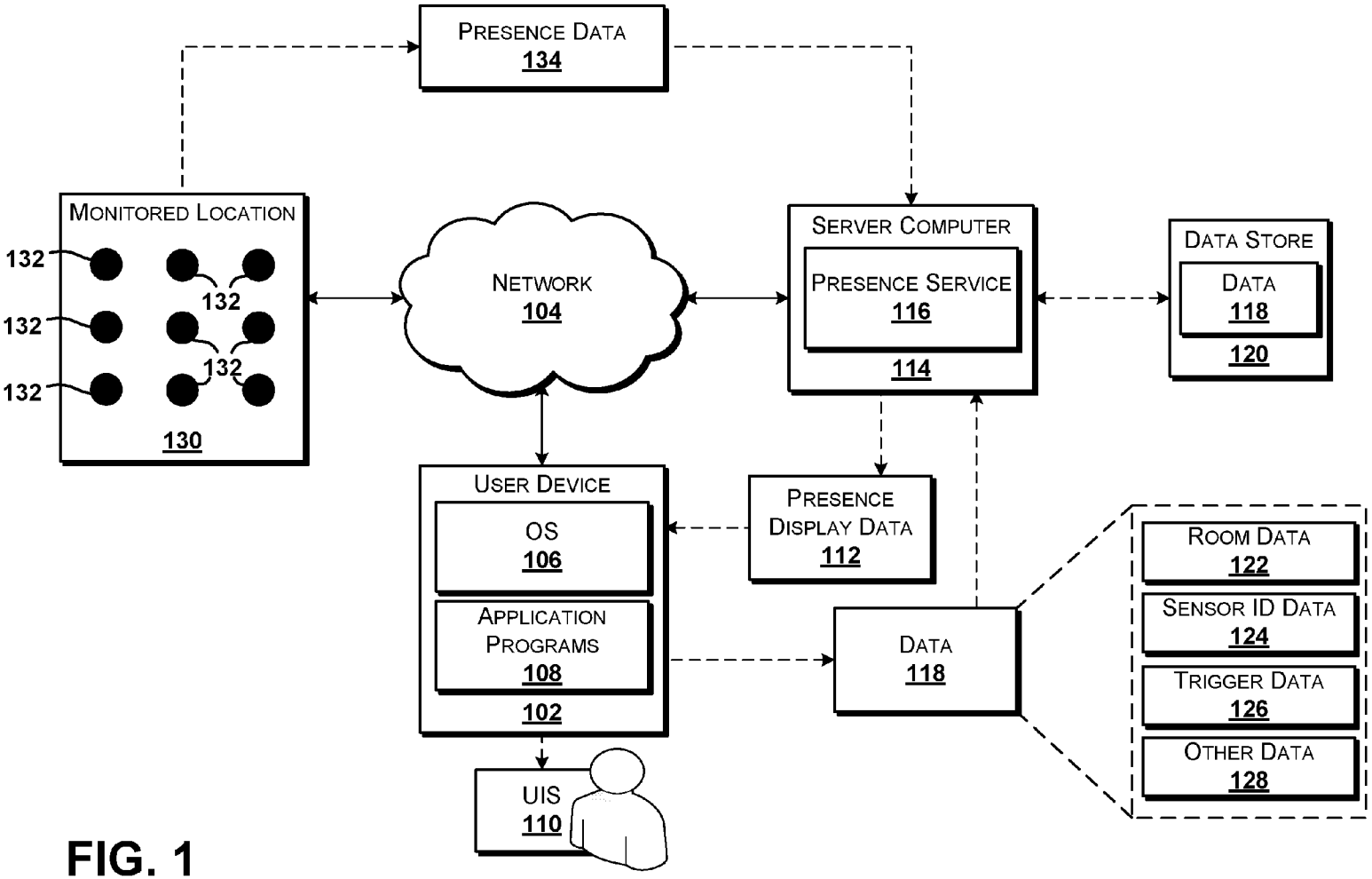
FIG. 1 is a system diagram illustrating an illustrative presence system for use in various embodiments of the concepts and technologies described herein.

The following detailed description is directed to detecting presence using a presence sensor network. According to various embodiments of the concepts and technologies described herein, a monitored location can be determined and/or selected. The monitored location can include an office, a home, a room, a sidewalk, an intersection, a cross walk, a bus stop, a train stop, an airport, a train, bus, or subway platform, a roadway or railway crossing, a store or other retail location, a vehicle, other locations, or the like. For purposes of illustrating and describing various embodiments of the concepts and technologies described herein, the monitored location is described herein as a store, office, or other retail location. It should be understood that this embodiment is illustrative, and should not be construed as being limiting in any way.

A number of presence sensors can be located at the monitored location. According to various embodiments of the concepts and technologies described herein, the functionality of the presence sensors can be provided by radio frequency identification ("RFID") tags. As will be explained in more detail below, RFID tags can provide an inexpensive and effective presence sensor. According to various embodiments of the concepts and technologies described herein, the RFID tags can be selected and/or configured such that the RFID tags respond to a radio signal emitted at a resonant frequency in only certain conditions. In particular, if a person is located between a particular RFID tag and a signal emitter, the person's body may absorb, reflect, or block the signal to the extent that the RFID tag does not power on in response to resonation of the antenna/conductive trace of the RFID tag. Thus, by monitoring responses from RFID tags in a vicinity of an emitter, a device can determine what, if any, RFID tags are blocked by a person or other object.

According to some embodiments, data describing the monitored location can be configured and saved via interactions with a presence service or other presence application or module. The data can be saved in a memory, drive, database, or other data storage device. In some embodiments, the data includes room data describing the room, location, region, area, or other aspect of the monitored location; sensor ID data describing locations (within the monitored location) and identities of presence sensors located at the monitored location; trigger data defining alerts, alarms, or other notification conditions that, when determined to exist at that monitored location, trigger an alarm, alert, or other notification; other information such as trend information, historical information; or the like.

The presence service can obtain presence data associated with the monitored location. The presence data can be provided by a computer or other computing system located at the monitored location. The presence data can be received by the presence service and used to determine presence at the monitored location. In some embodiments, the presence service compares the presence data to room data, sensor ID data, trigger data, other data, or the like, and determines the presence at the monitored location based upon this information. The presence service can generate presence display data that visually represents the determined presence, and also can trigger and/or generate alarms or alerts if determined to be appropriate based upon the determined presence. The presence display data can be provided to a user device, which can render one or more user interfaces for a user such as, for example, a manager, or the like.

In some embodiments, a user device obtains and uses the presence data and generates the presence display data. Thus, the presence service can be omitted in some embodiments, or may not be accessed in some instances. Thus, embodiments of the concepts and technologies described herein allow users to monitor a monitored location remotely and obtain alerts and/or alarms without viewing a video or monitoring the location in person. These and other aspects of the concepts and technologies described herein are illustrated and described below.

While the subject matter described herein is presented in the general context of program modules that execute in conjunction with the execution of an operating system and application programs on a computer system, those skilled in the art will recognize that other implementations may be performed in combination with other types of program modules. Generally, program modules include routines, programs, components, data structures, and other types of structures that perform particular tasks or implement particular abstract data types. Moreover, those skilled in the art will appreciate that the subject matter described herein may be practiced with other computer system configurations, including hand-held devices, multiprocessor systems, microprocessor-based or programmable consumer electronics, minicomputers, mainframe computers, and the like.

Referring now to FIG. 1, aspects of a presence system 100 that can be used in various embodiments of the concepts and technologies disclosed herein for detecting presence using a presence sensor network will be described, according to an illustrative embodiment. The presence system 100 shown in FIG. 1 includes a user device 102 operating in communication with and/or as part of a communications network ("network") 104, though this is not necessarily included.

According to various embodiments, the functionality of the user device 102 may be provided by one or more server computers, desktop computers, mobile telephones, smart phones, personal digital assistants, tablet computers, laptop computers, set-top boxes, other computing systems, and the like. It should be understood that the functionality of the user device 102 can be provided by a single device, by two similar devices, and/or by two or more dissimilar devices. For purposes of describing the concepts and technologies disclosed herein, the user device 102 is described herein as a mobile computing device such as a smartphone. It should be understood that this embodiment is illustrative, and should not be construed as being limiting in any way.

The user device 102 can execute an operating system 106 and one or more application programs 108. The operating system 106 is a computer program for controlling the operation of the user device 102. The application programs 108 are executable programs configured to execute on top of the operating system 106 to provide various functions. According to various embodiments, the application programs 108 include web browsers, web applications, native applications such as productivity software, inventory software, point-of-sale software, combinations thereof, or the like.

As is known, and as will be explained and illustrated in additional detail below, the application programs 108 can be configured to generate and/or present one or more user interfaces ("UIs") 110. In some embodiments, the UIs 110 are rendered at the user device 102 based upon data obtained by the user device 102. Thus, the UIs 110 can correspond, for example, to one or more web pages or web application displays obtained by the user device 102 from a remote computer such as a server or other host. In some embodiments, the user device 102 generates the UIs 110 by executing one or more of the application programs 108. Regardless of where or how the UIs 110 are generated, the UIs 110 can be configured to present presence information at the user device 102 and/or to support or allow interactions via which presence applications and/or presence services can be configured. Some illustrative examples of the UIs 110 are illustrated and described below in more detail with reference to FIGS. 5A-5G.

In some embodiments, the user device 102 generates the UIs 110 based upon presence display data 112. As explained above, the presence display data 112 can be generated by the user device 102 and/or obtained from a remote source such as, for example, a server computer 114. For purposes of illustrating and describing the concepts and technologies disclosed herein, FIG. 1 illustrates an embodiment wherein the presence display data 112 is obtained from the server computer 114. The presence display data 112 can include data that, when rendered at the user device 102, provides one or more of the UIs 110. Thus, the presence display data 112 can include one or more web page files, image files, scripts, combinations thereof, or the like. It should be understood that this example is illustrative, and should not be construed as being limiting in any way.

The presence display data 112 can be generated by an application or service hosted by the server computer 114. In the illustrated embodiment, the server computer 114 executes a presence service 116. The presence service 116 can be executed by the server computer 114 to provide the concepts and technologies disclosed herein for obtaining and presenting presence data and for generating, storing, hosting, and/or providing the presence display data 112. The functionality described herein with reference to the presence service 116 can be provided by one or more application programs 108 executed by the user device 102 in addition to, or instead of begin hosted by the server computer 114. As such, the example shown in FIG. 1 is illustrative and should not be construed as being limiting in any way.

The presence service 116 can be configured to obtain data 118 from the user device 102, for example, via one or more of the UIs 110 presented at or by the user device 102. The presence service 116 can obtain the data 118 and store the data 118 in a local or remote data storage device such as, for example, a data store 120. The functionality of the data store 120 can be provided by one or more databases, server computers, desktop computers, mobile telephones, laptop computers, other computing systems, and the like. As shown in FIG. 1, the data 118 can include, but is not limited to, various types of information such as, for example, room data 122, sensor ID data 124, trigger data 126, other data 128, combinations thereof, or the like.

The room data 122 can include, but is not limited to, data defining a monitored location 130 such as a room, building, vehicle, area, region, or the like. Thus, the room data 122 can define, for example, walls of a monitored location 130; furniture and/or fixtures within or at a monitored location 130; structures and/or other physical aspects of the monitored location 130; data defining portions and/or regions of the monitored locations 130, for example, data defining a portion or region of a monitored location 130 as a customer area, an operations area, or the like; and/or other data that defines the room and/or other area that is monitored via the presence service 116. The room data 122 also can define relationships between various structures, fixtures, and/or movable objects within the monitored location 130. Because the monitored location 130 can include a room or other area, region, structure, or the like, it should be understood that these examples of the room data 122 are illustrative, and should not be construed as being limiting in any way.

The sensor ID data 124 can include, but is not limited to, data that defines or describes one or more, or each, presence sensor 132 located at the monitored location 130. The sensor ID data 124 can therefore include, for example, a unique identifier for each presence sensor 132, as well as a location, within the monitored location 130, of the presence sensor 132. Thus, for example, the sensor ID data 124 can include a table or other data structure that defines a presence sensor 132 by way of a unique identifier for the presence sensor 132 and a location, within the monitored location 130, of the presence sensor 132. Because the sensor ID data 124 can include additional and/or alternative information, it should be understood that these examples of the sensor ID data 124 are illustrative, and should not be construed as being limiting in any way.

The trigger data 126 can include, for example, data that defines one or more triggers for presence-based alarms, alerts, and/or other types of notifications. As used herein, a "presence-based alarm" can include, for example, an alarm, alert, or other notification that can be generated by the presence service 116 in response to detecting a presence condition at the monitored location 130 and/or in response to detecting other conditions or trends at the monitored location 130. Thus, presence-based alarms can be generated or triggered by the presence service 116, for example, in response to detecting a number of people at the monitored location 130, a number of people at a portion or area of the monitored location 130, a trend in the number of people at the monitored location 130 and/or portion thereof, a time duration for which a number of people has been exceeded at the monitored location 130, a concentration of people at the monitored location 130 and/or a portion thereof, combinations thereof, or the like.

As will be explained in more detail below, a presence-based alarm can be generated, for example, if a line at or near a cash register, display, door, or other area of the monitored location 130 reaches a defined length or concentration threshold. Thus, the presence-based alarm can be used to alert a manager or other party that an action, e.g., opening another register, investigating a crowd, or the like, should be taken. It should be understood that these examples are illustrative, and should not be construed as being limiting in any way.

The other data 128 can include various types of information that can be interpreted and/or used by the presence service 116 to provide the functionality described herein. Thus, the other data 128 can include, for example, trend information, historical information, time and/or location information, shift change information, employee schedule information, combinations thereof, or the like. Thus, the presence service 116 can be configured to use the other data 128, for example historical and/or trend information, to predict and/or interpret presence changes at the monitored location 130. For example, the presence service 116 can be configured, in some embodiments, to use the trend and/or historical information to interpret presence changes to understand presence changes, to prompt action or to suppress action, e.g., if a presence change corresponds to a "normal" or anticipated change in presence based upon historical and/or trend information, or the like. It should be understood that these examples are illustrative, and should not be construed as being limiting in any way.

The presence service 116 also can be configured to obtain presence data 134 associated with the monitored location 130. The presence data 134 can include, for example, a list or table of presence sensor identifiers at a particular time and therefore can be used by the presence service 116 to determine presence at the monitored location 130. According to some embodiments, the presence data 134 can be captured via one or more receivers or transceivers (not visible in FIG. 1) located at or near the monitored location 130. The presence data 134 can be obtained and/or packaged by one or more computing devices in communication with the receivers and/or transceivers and/or can be provided to the presence service 116 in other ways. These and other aspects of obtaining presence data 134 at or near the monitored location 130 will be described in additional detail below, particularly with reference to FIGS. 2-4.

In operation, the concepts and technologies disclosed herein can be used to provide a presence service 116 to a user and/or other entities. A monitored location 130 can be equipped with one or more presence sensors 132. According to various embodiments, the presence sensors 132 are radio frequency identification ("RFID") devices ("RFID tags"). According to various embodiments of the concepts and technologies disclosed herein, RFID tags can be used to provide the functionality described herein for the presence sensors 132 because the RFID tags can be inexpensive, often costing one or more cents per piece, or even a fraction of a cent, reliable, and relatively easy to install and/or retrofit to a monitored location 130 since independent communication and/or electricity media may be unnecessary.

Furthermore, RFID tags are used in some embodiments of the concepts and technologies disclosed herein because RFID tags can be configured to provide an ID in response to a signal emitted at a resonant frequency, and because the RFID tags can be configured not to respond to the signal emitted at the resonant frequency if a body of a person is located between a device emitting the signal and the RFID tag. Thus, some embodiments of the concepts and technologies disclosed herein provide the presence data 134 by way of emitting signals in one or more resonant frequencies and detecting which (if any) RFID tags are occluded and/or which RFID tags are not occluded by a person and/or people based upon which RFID tags respond to the emitted signal.

As such, various embodiments of the concepts and technologies disclosed herein can provide a relatively inexpensive network of presence sensors ("presence sensor network") and/or use presence information gathered by the presence sensor network. The presence sensor network can be provided by RFID tags disposed at or throughout a monitored location 130. The RFID tags can be periodically and/or continuously polled by an emitter such as an RF transceiver that emits a signal in a resonant frequency (or frequencies). By monitoring the monitored location 130 with a receiver and/or a transceiver, a presence service 116 can obtain presence data 134 that identifies RFID tags that are activated by the signal emitted at the resonant frequency (or frequencies) and/or what RFID tags are not activated by the signal emitted at the resonant frequency (or frequencies). RFID tags that are not activated by the signal emitted in the resonant frequency can be determined, by the presence service 116, to correspond to RFID tags that are occluded by a person or people between the signal emitter and the RFID tags. The presence data 134 can be reported to and/or obtained by the presence service 116.

The presence service 116 can obtain the presence data 134, and compare the presence data 134 with the sensor ID data 124 and/or other information stored as the data 118 described herein. By referencing the sensor ID data 124, the presence service 116 can identify which presence sensors 132 are activated and/or which presence sensors 132 are not activated at a particular time based upon the inclusion or exclusion of presence sensor identifiers in the presence data 134. This information can be used by the presence service 116 to determine presence at or near a monitored location 130, as will be explained in additional detail below.

The presence service 116 can generate, based upon the data 118 and the presence data 134, presence display data 112. As explained above, the presence display data 112 can correspond to a web page, an image, and/or other types of information that can be provided to the user device 102 and/or other devices to render a display such as the UIs 110. In addition to, or instead of, visual information, the presence display data 112 can include alerts, alarms, and/or indicators for indicating that an alert and/or alarm condition exists at the monitored location 130. Thus, embodiments of the concepts and technologies disclosed herein can enable alerts and alarms based upon detected presence conditions at or near the monitored location 130. These and other aspects of the concepts and technologies disclosed herein will be illustrated and described in more detail below with reference to FIGS. 2-11.

FIG. 1 illustrates one user device 102, one network 104, one server computer 114, one data store 120, and one monitored location 130. It should be understood, however, that various implementations of the presence system 100 include zero, one, or more than one user device 102; zero, one, or more than one network 104; zero, one, or more than one server computer 114; zero, one, or more than one data store 120; and zero, one, or more than one monitored location 130. As such, the illustrated embodiment should be understood as being illustrative, and should not be construed as being limiting in any way.

Figure 2:
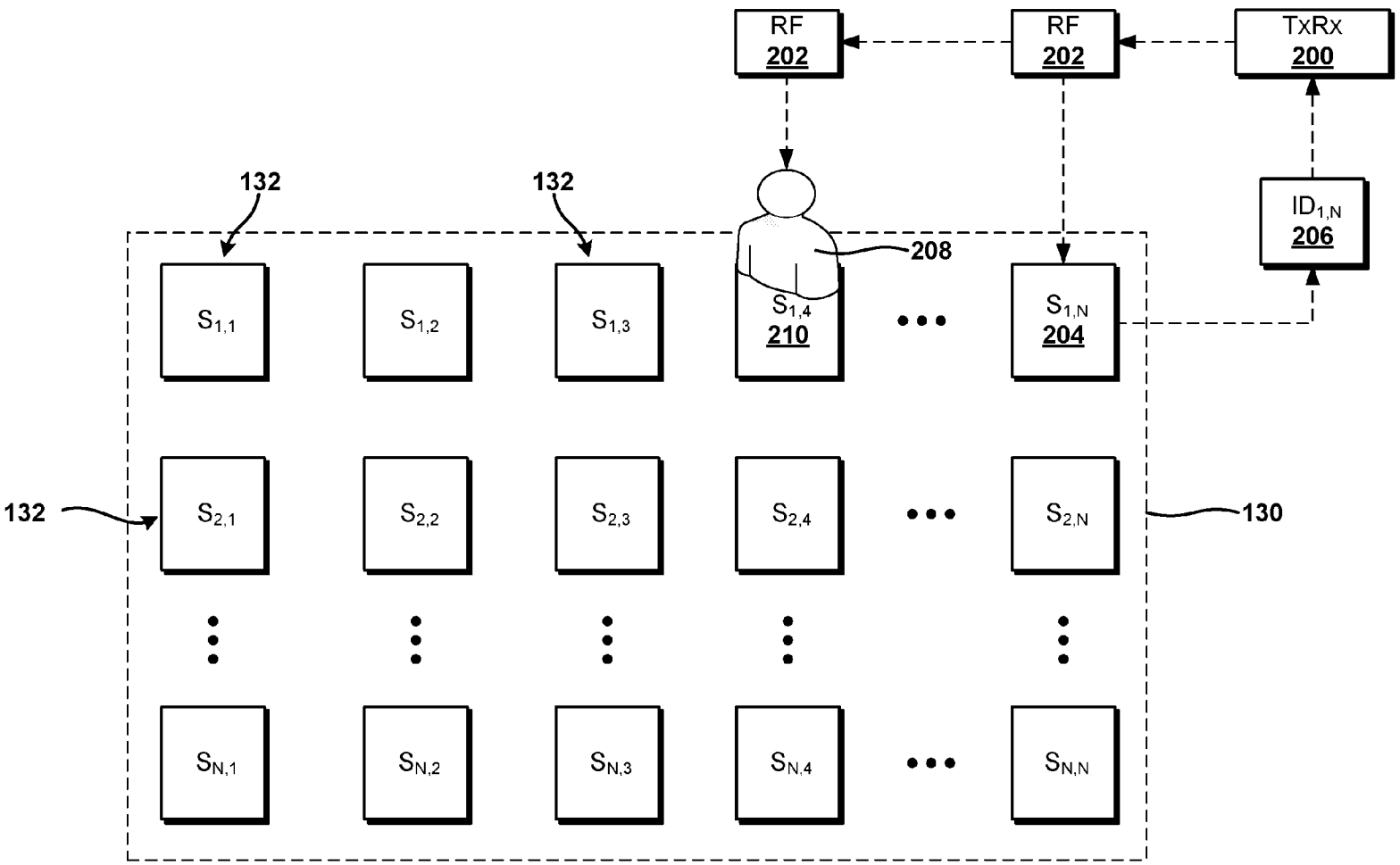
FIG. 2 is a block diagram schematically illustrating additional aspects of the concepts and technologies disclosed herein, according to an illustrative embodiment.

Turning now to FIG. 2, additional aspects of the concepts and technologies disclosed herein are described in detail. In particular, FIG. 2 shows a schematic view of a monitored location 130, according to one embodiment of the concepts and technologies disclosed herein. As shown in FIG. 2, a number of presence sensors 132 are shown located at, near, or within a monitored location 130. In accordance with various embodiments of the concepts and technologies disclosed herein, the functionality of the presence sensors 132 can be provided by RFID tags. Thus, the presence sensors 132 can be located such that the presence sensors 132 can receive a signal emitted at a resonant frequency and/or at a combination of resonant frequencies. Furthermore, the presence sensors 132 can be located such that when one or more of the presence sensors 132 resonates in response to exposure to the signal emitted at the resonant frequency (or frequencies), signals emitted by the presence sensors 132 can be detected by a receiver or transceiver located at or near the monitored location 130.

In FIG. 2, the monitored location 130 includes a number of presence sensors 132. A combination radio frequency emitter and radio frequency receiver ("transceiver," labeled in FIG. 2 as TxRx") 200 is located at or near the monitored location 130. While only one transceiver 200 is shown in FIG. 2, it should be understood that various embodiments of the concepts and technologies disclosed herein include multiple transceivers 200. In particular, some embodiments of the concepts and technologies disclosed herein rely upon multiple transceivers 200 to increase a probability that a body of a person will prevent responding by the presence sensors 132.

In some embodiments, for example, the multiple transceivers 200 are configured to emit a signal at a reduced power (less than full power and/or less than a typical power at which the signal is emitted). Thus, the range of the transceivers 200 can be decreased. Multiple transceivers 200 can be dispersed at multiple locations within or near the monitored location 130, embodiments of the concepts and technologies disclosed herein can maximize the occlusion effect mentioned above by increasing a degree to which a body occludes the resonant frequency (since the frequency is emitted at a low power). It should be understood that these examples are illustrative, and should not be construed as being limiting in any way.

As shown in FIG. 2, the transceiver 200 can emit a radio signal at resonant frequency and/or can emit a number of radio signals in a combination of resonant frequencies. This radio signal, or signals, are shown in FIG. 2 labeled as RF 202. It can be appreciated that a radio signal can be emitted in non-directional manner, and that the illustrated embodiment is provided merely to illustrate the concepts and technologies disclosed herein. The RF 202 can arrive at and/or be encountered by any number of the presence sensors 132. In FIG. 2, the presence sensor 132 labeled $S_{1,N}$ receives the RF 202 and a conductive trace or other antenna of the presence sensor 132 can resonate to power an integrated circuit ("IC") chip associated with the presence sensor 132. In response to the power generated by the presence sensor 132, the IC can generate a signal that includes a unique identifier associated with the presence sensor 132. Thus, the presence sensor 132 can, by virtue of receiving the RF 202, become a read presence sensor 204, and can provide a signal including a unique identifier 206 to the transceiver 200. It should be understood that this example is illustrative, and should not be construed as being limiting in any way.

The RF 202 can also arrive at or near other presence sensors 132. In FIG. 2, the presence sensor 132 labeled $S_{1,4}$ can be within range of the RF 202 emitted by the transceiver 200, but because a body of a person 208 can be located between the transceiver 200 and the presence sensor 132, the presence sensor 132 labeled $S_{1,4}$ can correspond to an occluded presence sensor 210. The occluded presence sensor 210 therefore may not generate a signal in response to the RF 202, or any signal generated by the occluded presence sensor 210 may be of reduced power and may not reach the transceiver 200. Thus, the presence sensor 132 can, by virtue of not receiving the RF 202, become a occluded presence sensor 210, and information indicating that the occluded presence sensor 210 does not provide a signal can be interpreted as indicating presence of the person 208 at or near the occluded presence sensor 210. The information indicating the occlusion or response of the various presence sensors 132 can be used by the presence service 116 to provide various functionality as described below in more detail.

Figure 3:
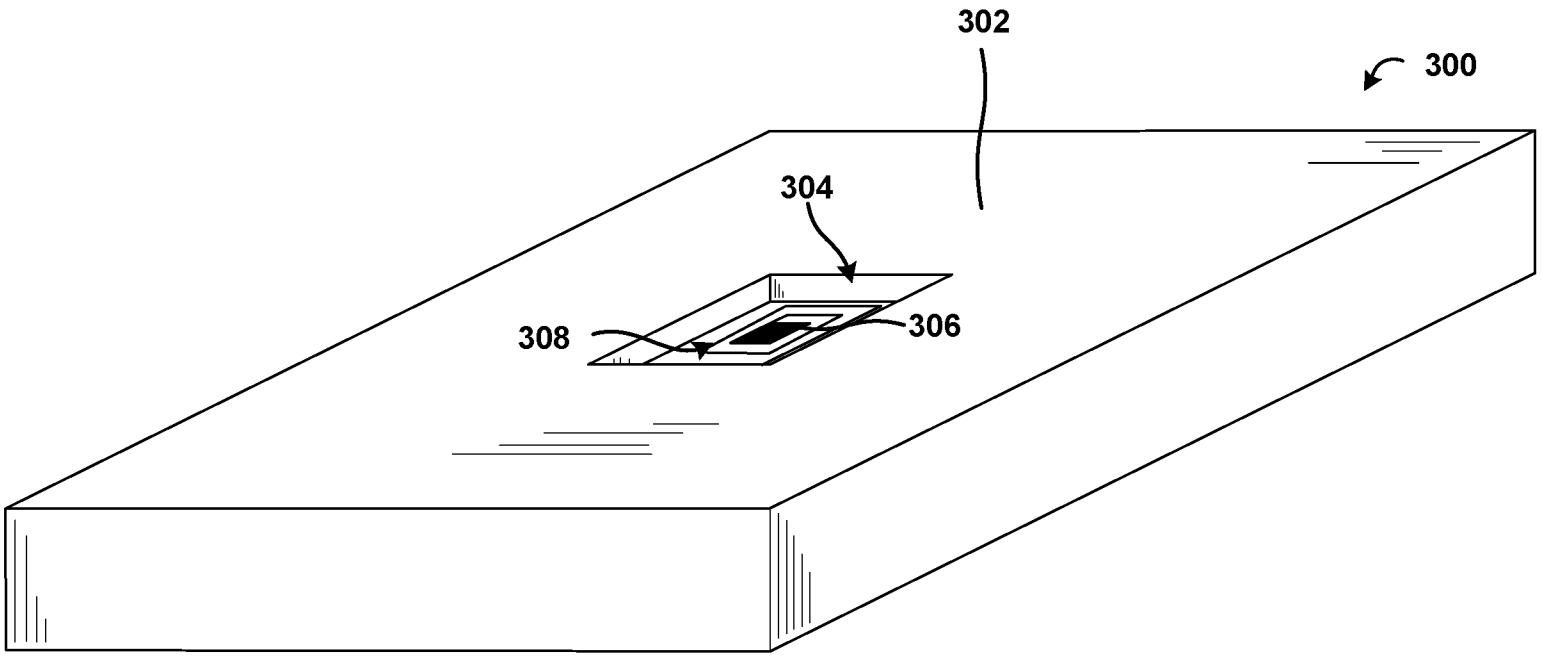
FIG. 3 is a line drawing illustrating an example embodiment of a presence sensor, according to an illustrative embodiment.

Turning now to FIG. 3, additional aspects of the concepts and technologies disclosed herein are described in detail. In particular, FIG. 3 is a line drawing showing an illustrative presence sensor 300, according to some embodiments of the concepts and technologies disclosed herein. It should be appreciated that the presence sensor 300 shown in FIG. 3 can provide the functionality described herein with reference to the presence sensor 132, the read presence sensor 204, and/or the occluded presence sensor 210. It should be understood that these examples are illustrative, and should not be construed as being limiting in any way.

As shown in FIG. 3, the presence sensor 300 can include a substrate 302. The substrate 302 can be formed from linoleum, ceramics, carpets, woods, plastics and/or other polymers, glasses, metals, epoxies and/or other resins, other materials, combinations thereof, or the like. According to some embodiments, the functionality of the substrate 302 can be provided by a floor tile such as a linoleum tile or a ceramic tile. It should be understood that these examples are illustrative, and should not be construed as being limiting in any way.

The substrate 302 can include a recess or other hollowed area ("recess") 304, though this is not necessarily the case. The recess 304 can be formed any number of ways including molding, machining, electronic discharge, combinations thereof, or the like. The hollow can be formed in the substrate 302 to house an RFID tag 306. In some embodiments, the recess 304 can be omitted and the RFID tag 306 can be attached to the substrate 302. In some implementations, attaching the RFID tag 306 to the substrate 302 can provide convenient, easy, and/or machining-free installation of the RFID tag 306, though this is not necessarily the case. As is generally understood, the RFID tag 306 can include and/or can be coupled to a conductive trace or other antenna ("antenna") 308. When a resonant frequency is emitted at or near the presence sensor 300, the antenna 308 can resonate, thereby generating a current that powers the RFID tag 306, an integrated circuit, and/or other hardware coupled to the antenna 308.

The RFID tag 306 can, in response to being powered by the antenna 308, generate and emit a signal that includes a unique identifier associated with the RFID tag 306 (and only that RFID tag 306). If a person is located between the RFID tag 306 and a source of the resonant frequency, the RFID tag 306 may not be powered by the resonant frequency and therefore may not respond with the unique identifier associated with that presence sensor 300. Alternatively, the RFID tag 306 may be powered by the resonant frequency and may respond with the unique identifier, but the response signal may not reach a receiver or transceiver due to being blocked by the person and/or due to a reduced power of the signal by virtue of being blocked by the person. Thus, by monitoring a number of RFID tags 306 of a number of presence sensors 300 and/or signals emitted thereby, presence of people at or near the presence sensors 300 can be detected. It should be understood that these examples are illustrative, and should not be construed as being limiting in any way.

Figure 4:
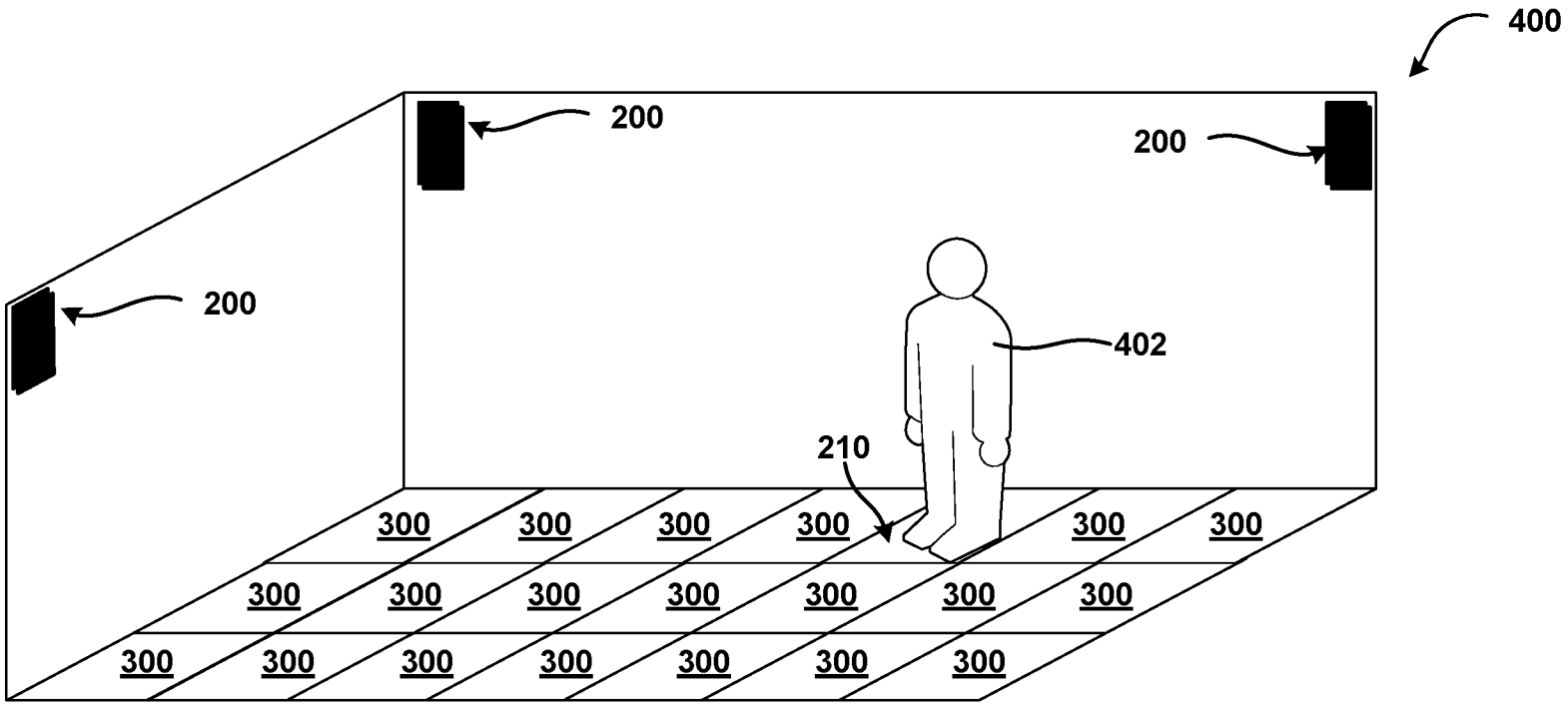
FIG. 4 is a line drawing illustrating an example implementation of the concepts and technologies disclosed herein for detecting presence using a presence sensor network, according to one illustrative embodiment.

Turning now to FIG. 4, an example implementation of the presence sensors 300 is shown, according to an illustrative embodiment of the concepts and technologies disclosed herein. As shown in FIG. 4, a room 400 can correspond to a monitored location 130. A floor of the room can be tiled with a number of the presence sensors 300 illustrated and described above with reference to FIG. 3. It should be understood that other presence sensors 132 can be used in accordance with various embodiments of the concepts and technologies disclosed herein.

The room 400 also can include a number of transceivers (labeled in FIG. 4 as "TxRx") 200, as explained above. The transceivers 200 in the room 400 can continuously and/or periodically emit a signal and/or signals at a resonant frequency and/or a combination of resonant frequencies. The transceivers 200 also can monitor the room 400 for signals emitted by the presence sensors 300. Thus, the transceivers 200 can determine if any of the presence sensors 300 are occluded at a particular time. As shown in FIG. 4, one or more of the presence sensors 300 may be occluded by a person 402. As such, the transceiver 200 may not receive a signal associated with the occluded presence sensor 210, though the transceiver 200 may receive signals associated with the other presence sensors 300 in the room 400. In the example illustrated in FIG. 4, presence data 134 can indicate twenty presence sensors 300, instead of twenty-one. Thus, a computing system or application such as the presence service 116 can determine that one of the presence sensors 300 is occluded and use that information to provide presence information. It should be understood that these examples are illustrative, and should not be construed as being limiting in any way.

Figure 5A:
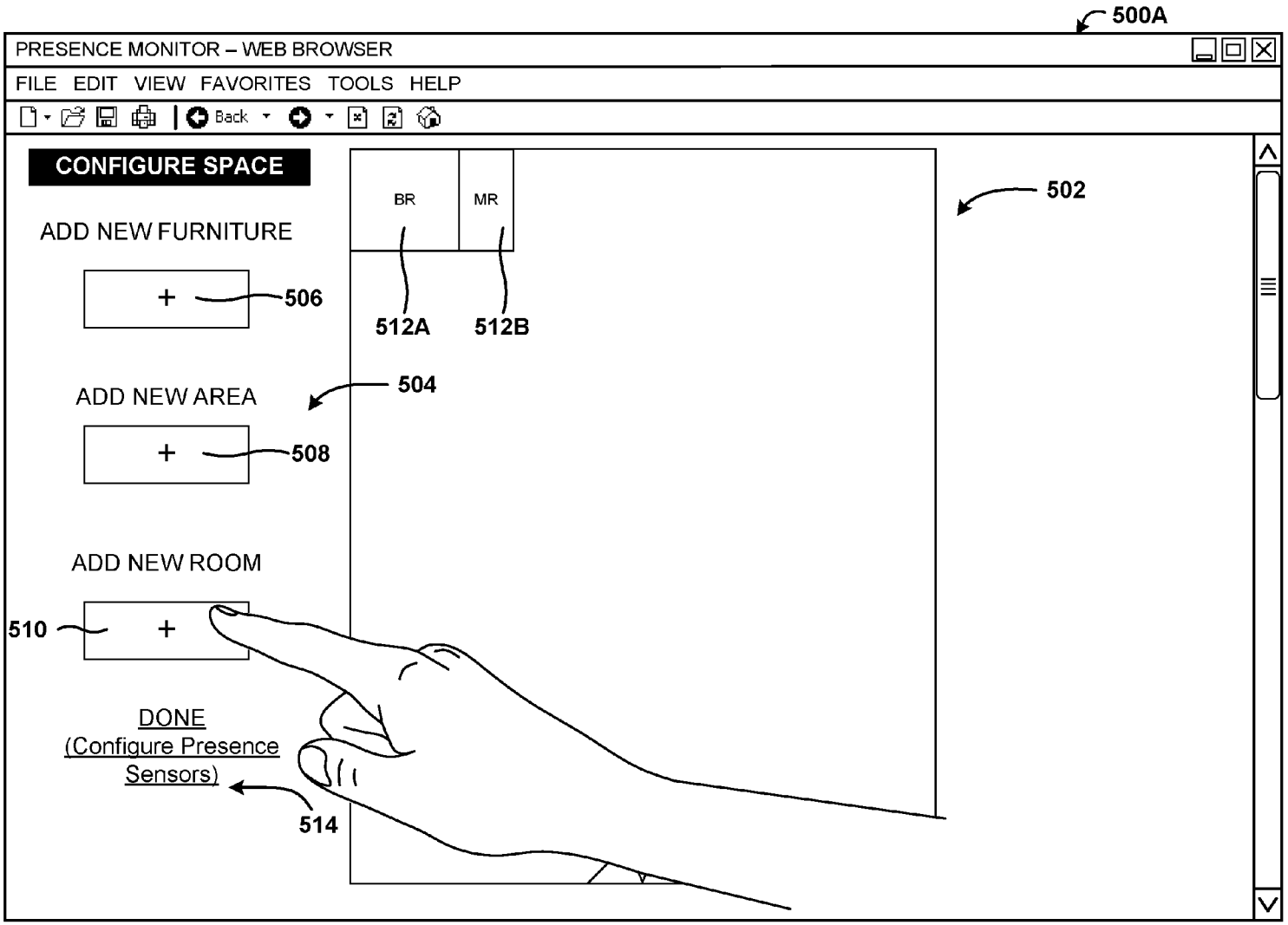
FIGS. 5A-5G are user interface diagrams illustrating example screen displays for presenting presence information, according to some illustrative embodiments of the concepts and technologies disclosed herein.

FIGS. 5A-5G are user interface ("UI") diagrams showing aspects of UIs for collecting and using presence information to provide a presence service, according to some illustrative embodiments of the concepts and technologies described herein. FIG. 5A shows an illustrative screen display 500A generated by a device such as the user device 102. According to various embodiments, the user device 102 can generate the screen display 500A and/or other screen displays in conjunction with and/or based upon data, for example the presence display data 112, which can be received from and/or generated by the presence service 116 described herein. It should be appreciated that the UI diagram illustrated in FIG. 5A is illustrative of one contemplated example of the UIs 110 and therefore should not be construed as being limited in any way.

The screen display 500A can include various menus and/or menu options. The screen display 500A also can include a monitored location representation 502, which can correspond to a visual representation or a map of the monitored location 130. For purposes of illustrating and describing the concepts and technologies disclosed herein, the monitored location representation 502 is illustrated as showing a store or other retail location. It should be understood that this example is illustrative, and should not be construed as being limiting in any way.

The screen display 500A also includes a monitored location representation configuration tab 504 for configuring and/or generating the monitored location representation 502. As shown in FIG. 5A, the UIs 110 can be interacted with to generate a representation of the monitored location 130 via adding furniture representations, area representations, room representations, other representations, or the like. Thus, for example, a user or other entity can create a representation of a monitored location 130 and/or edit a representation of the monitored location 130 to reflect changes. In the illustrated embodiment, the monitored location representation configuration tab 504 includes a UI control 506 for adding one or more representations of furniture, a UI control 508 for adding one or more representations of areas, a UI control 510 for adding one or more representations of rooms, combinations thereof, or the like. It should be understood that other UI controls can be included for adding other types of representations, if desired.

Figure 5B:
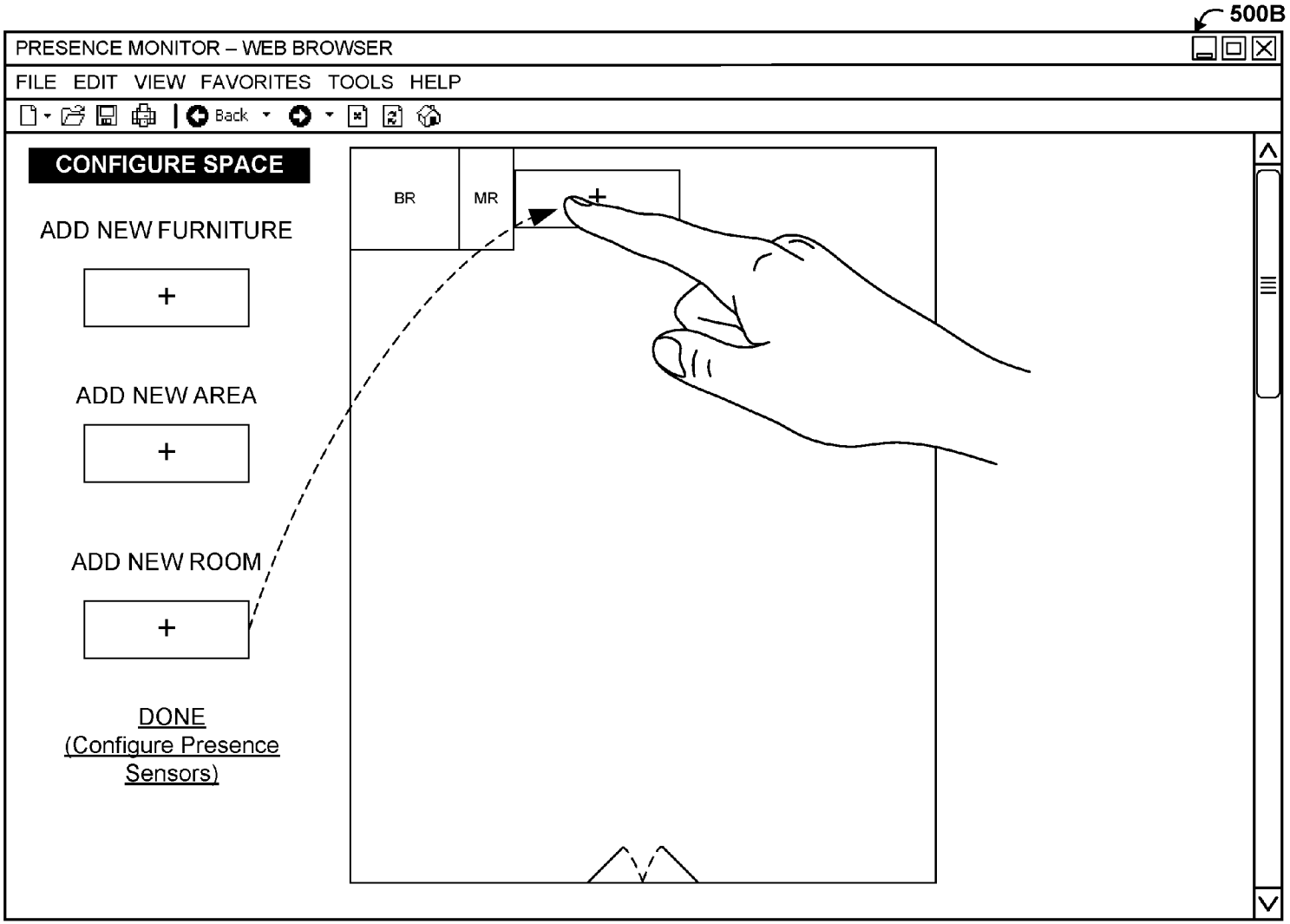
Figure 5C:
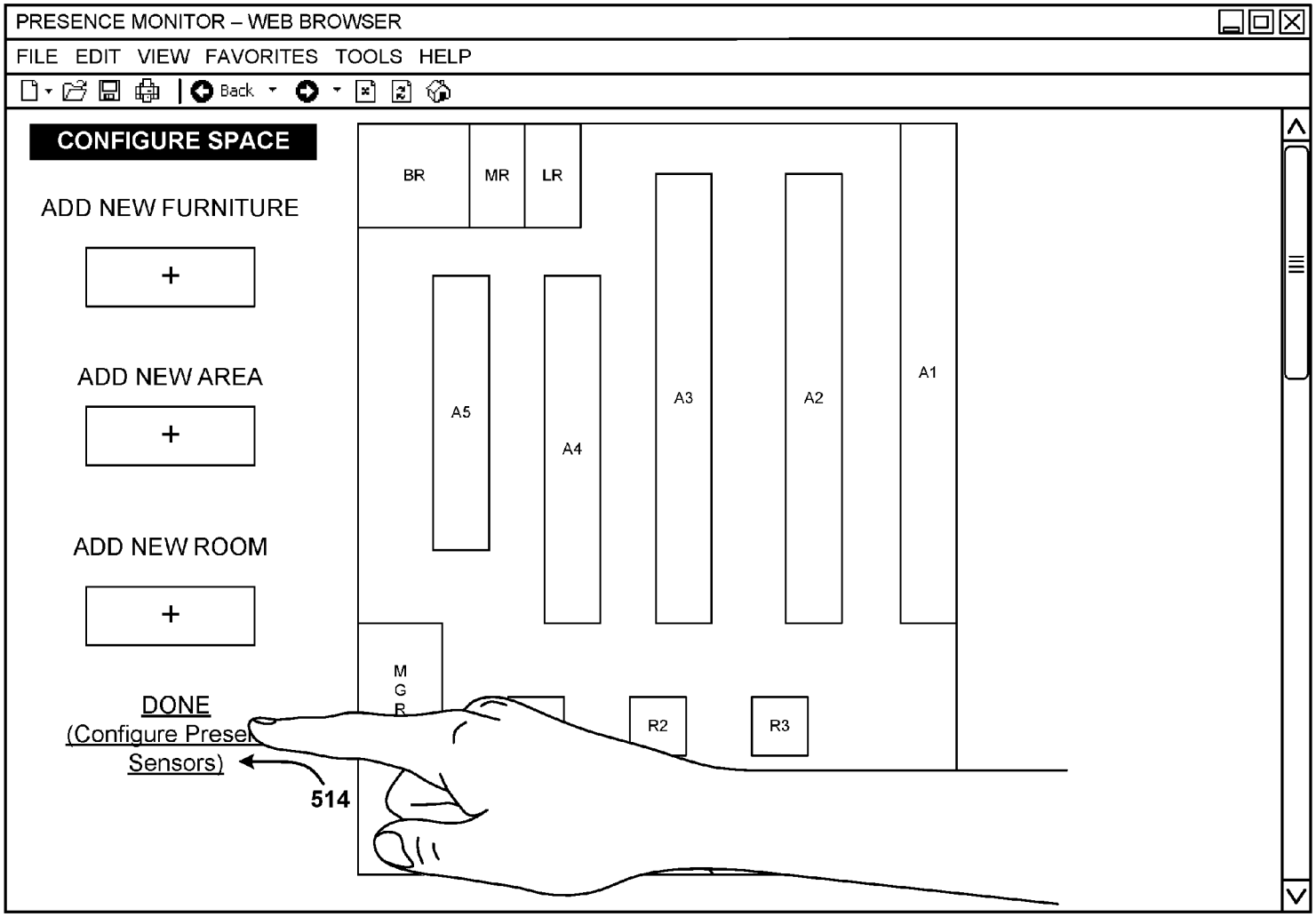

The monitored location representation 502 is illustrated as including two rooms 512A-B, which are shown as illustrating a break room (labeled "BR") and a men's restroom (labeled "MR"). It should be understood that this example is illustrative, and should not be construed as being limiting in any way. As shown collectively with reference to FIGS. 5A-5B, a user or other entity can add a room to the monitored location representation 502 by tapping and/or dragging and dropping a new room via the UI control 510. It should be understood that this example is illustrative, and should not be construed as being limiting in any way. As shown in FIGS. 5A-5C, the user or other entity can build the monitored location representation 502 via these and/or other interactions with the UIs 110.

Although not visible in FIGS. 5A-5G, it can be appreciated from the description of FIG. 1 that the data generated by way of these interactions can be stored by the presence service 116 as the room data 122 and/or other data included in the data 118, if desired. When the user or other entity has completed configuring the monitored location representation 502, the user or other entity can select the UI control 514 as shown in FIG. 5C.

With reference to FIG. 5C, it can be appreciated that the user or other entity can create a representation of a store, retail space, or other monitored location. In the embodiment shown in FIG. 5C, five aisles are shown (labeled "A1-A5"). Additionally, the representation includes a break room (labeled "BR"), a men's room (labeled "MR"), a ladies' room (labeled "LR"), a manager's area (labeled "MGR"), and three registers or other point-of-sale locations (labeled "R1-R3"). Other areas, furniture, and/or rooms can be included in the monitored location representation 502, but are not necessarily visible in the embodiment shown in FIGS. 5A-5C.

Figure 5D:
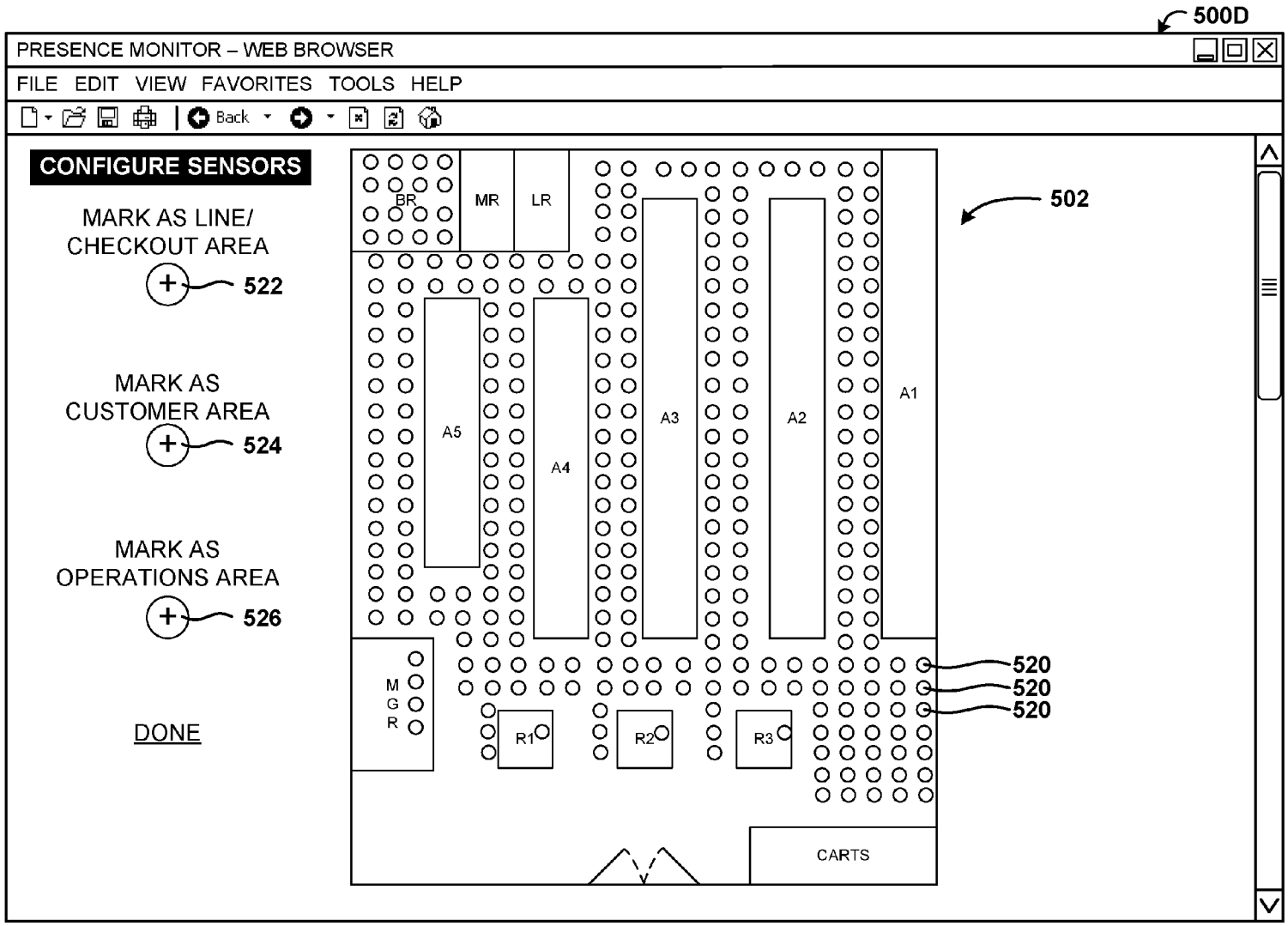

Upon selecting the UI control 514, the user device 102 can present another UI 110 to allow the user or other entity to configure presence sensors 132 included in the monitored location 130. An example of such a UI 110 is shown in FIG. 5D. In particular, FIG. 5D shows an illustrative screen display 500D generated by a device such as the user device 102. It should be appreciated that the UI diagram illustrated in FIG. 5D is illustrative of one contemplated example of the UIs 110 and therefore should not be construed as being limited in any way.

The screen display 500D can correspond to a UI 110 that can be interacted with by a user or other entity to define locations of one or more presence sensors 132. According to various embodiments, the locations of the presence sensor representations 520 within the monitored location representation 502 can be set by a user or other entity via interactions with the UI 110. In some embodiments, the user device 102 and/or the presence service 116 support importing tables or other data structures that include representations of each presence sensor 132 located in the actual monitored location 130. Thus, for example, an installer or install team can generate a table or other data structure that defines locations of the presence sensors 132 and/or their respective locations within the actual monitored location 130 and provide that data to the presence service 116. Furthermore, it can be appreciated that the installer or install team can generate the monitored location representation 502, in some embodiments.

A user or other entity also can select one or more of the presence sensor representations 520 and select the UI control 522 to mark the presence sensor(s) 132 associated with the presence sensor representation(s) 520 as part of a checkout line or checkout area. The user or other entity also can select one or more of the presence sensor representations 520 and select the UI control 524 to mark the presence sensor(s) 132 associated with the presence sensor representation(s) 520 as a customer area. Additionally, the user or other entity can select one or more of the presence sensor representations 520 and select the UI control 526 to mark the presence sensor(s) 132 associated with the presence sensor representation(s) 520 as an operations area that is not accessible to customers and/or associated with customer activity. For example, the user or other entity may mark any presence sensors 132 within the break room, manager's area, and/or at the employee side of the cash registers as being operations areas. It should be understood that these examples are illustrative, and should not be construed as being limiting in any way.

It can be appreciated that the data 118 can define an association for one or more (or all) of the presence sensors 132 represented by the presence sensor representations 520. In particular, the data 118 can associate the presence sensors 132 with unique identifiers of the actual presence sensors 132 located at the monitored location 130. As such, if the presence service 116 receives the presence data 134, the presence service 116 can interpret the presence data 134, in conjunction with the data 118, to indicate on a UI 110 where people are located within the monitored location 130 based upon received unique identifiers as well as unique identifiers that are not received. An example of a presence display is illustrated and described in more detail below, particularly with reference to FIG. 5G.

Figure 5E:
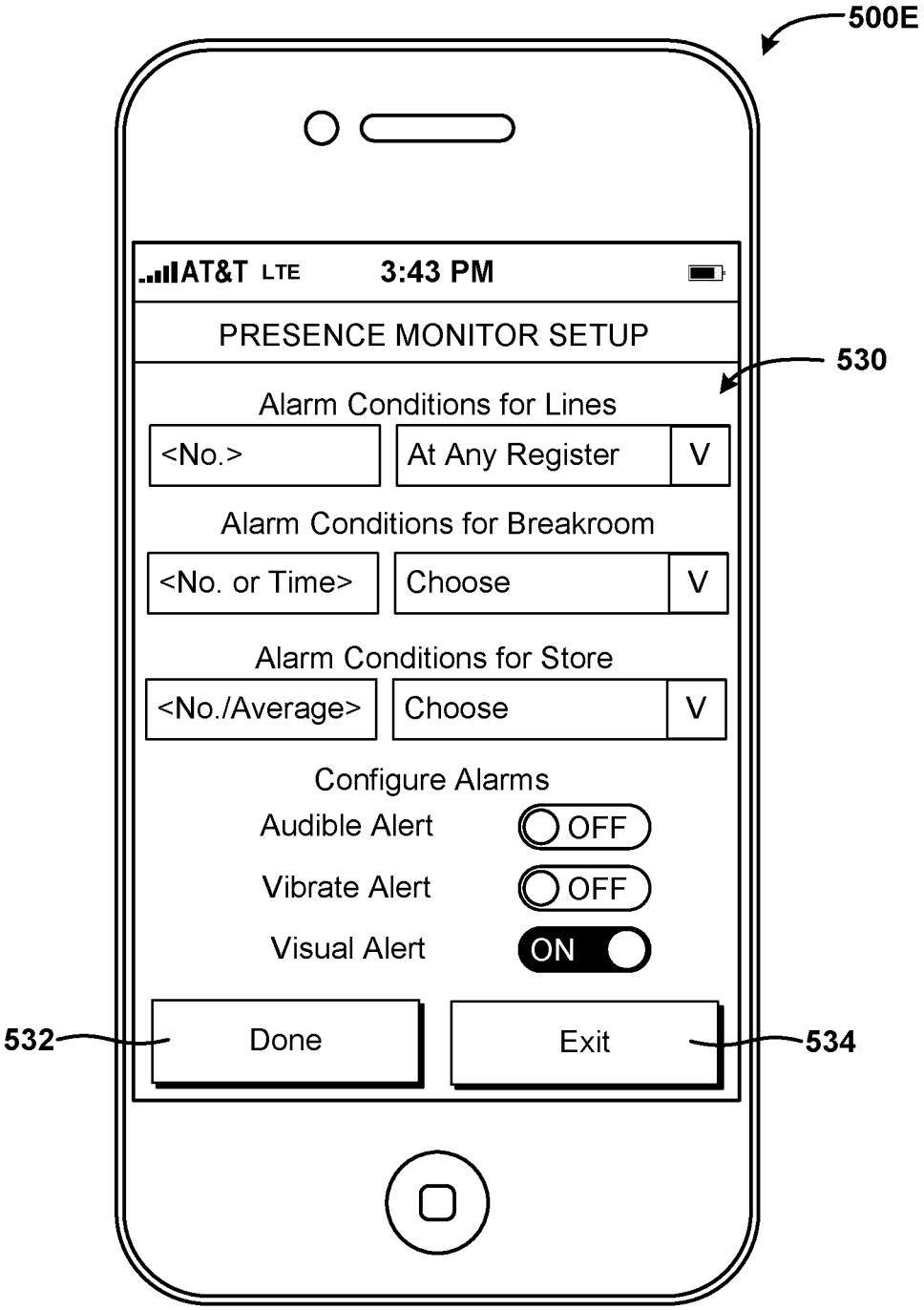

Referring now to FIG. 5E, a UI diagram showing additional aspects of the concepts and technologies disclosed herein for collecting and using presence information are described in detail. In particular, FIG. 5E shows an illustrative screen display 500E generated by a device such as the user device 102. It should be appreciated that the UI diagram illustrated in FIG. 5E is illustrative of one contemplated example of the UIs 110 and therefore should not be construed as being limited in any way. As shown in FIG. 5E, the screen display 500E can be presented on a mobile computing device such as a smartphone, if desired. It should be understood that this example is illustrative, and should not be construed as being limiting in any way.

The screen display 500E can include a presence monitor preferences screen 530. The presence monitor preferences screen 530 can be used to allow users or other entities to configure various aspects of the presence service 116 described herein. The preferences screen 530 also can be used to define or configure how data generated by the presence service 116 is used and/or interpreted by the user device 102. Thus, a user or other entity may specify, for example, alarm conditions for lines; alarm conditions for a break room; alarm conditions for a store (or other monitored location 130); how alarms are to be presented at the user device 102; other alarm, alert, or notification triggers; other options; combinations thereof; or the like. Because other preferences are contemplated, it should be understood that these examples are illustrative, and should not be construed as being limiting in any way. For example, some embodiments of the concepts and technologies disclosed herein provide options for configuring how and when alerts are and/or are not pushed to the user device 102, store hours, special events, combinations thereof, or the like.

Alarm conditions for lines can be specified, for example, by defining thresholds for a number of people at or near a cash register or other point-of-sale, a length of a line at or near the points-of-sale, a concentration of people at or near the points-of-sale, a time of wait at the points-of-sale, combinations thereof, or the like. The alarm conditions for the break room can include, for example, a number of people in the break room, a length of time the break room is occupied, a time of day or day of the week on or at which the break room is occupied, combinations thereof, or the like. The alarm conditions for the store (or other monitored location 130) can include, for example, a total number of customers or other people in the monitored location 130, an average number of people at the monitored location 130, combinations thereof, or the like. It should be understood that these examples are illustrative, and should not be construed as being limiting in any way.

The screen display 500E also can provide options for defining alerts or alarms to be generated by the presence service 116. Thus, for example, the screen display 500E can be used to enable and/or configure audible alerts, vibrate or other tactile alerts, visual alerts, other alerts, or the like. As noted above, other preferences are contemplated but are not shown in FIG. 5E due to the space limitations. Thus, the embodiment shown in FIG. 5E should be understood as being illustrative and should not be construed as being limiting in any way. The screen display 500E also includes a UI control 532 for accepting the preferences and a UI control 534 for exiting the preferences.

Figure 5F:
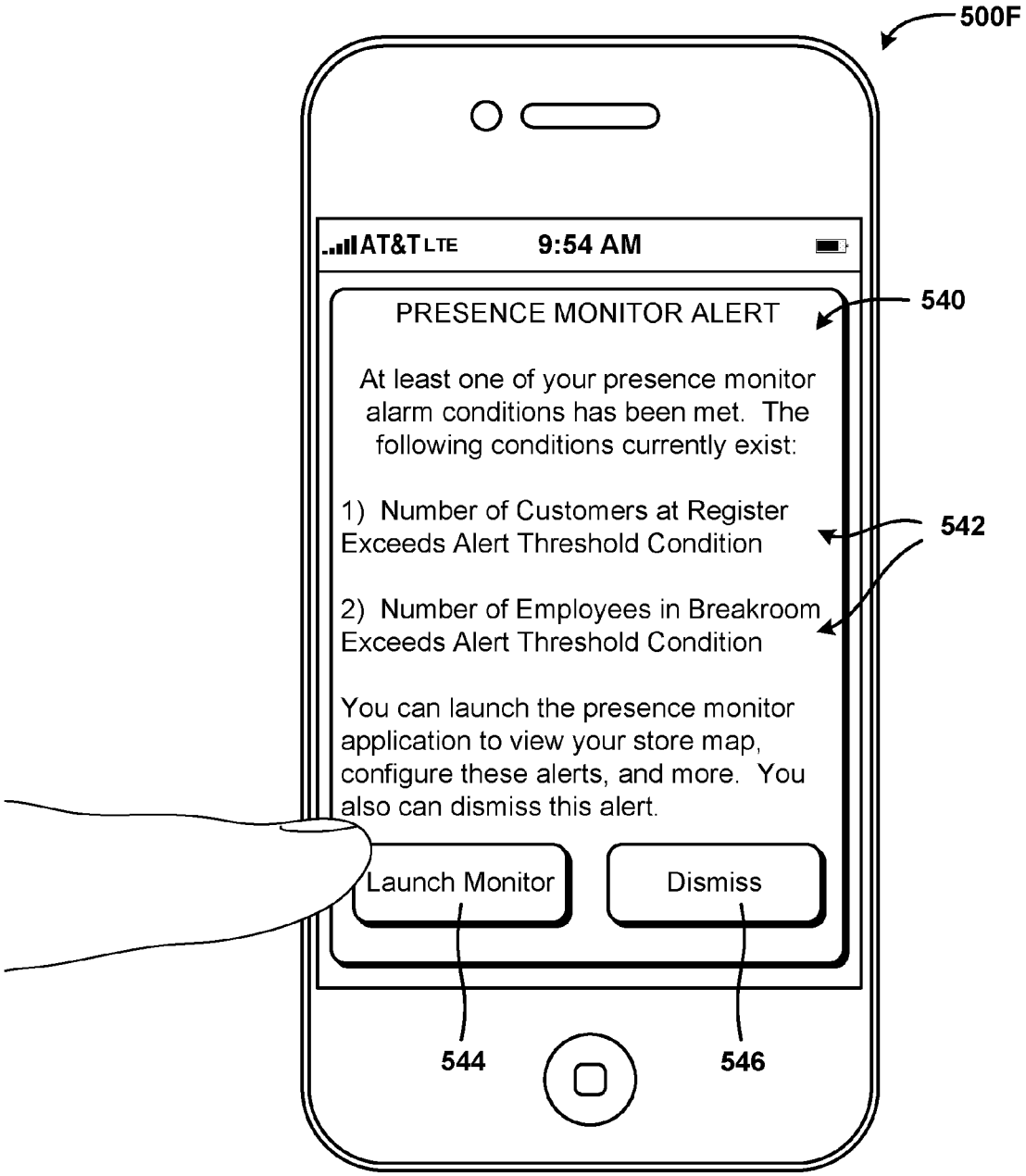

Turning now to FIG. 5F, a UI diagram showing additional aspects of the concepts and technologies disclosed herein for collecting and using presence information are described in detail. In particular, FIG. 5F shows an illustrative screen display 500F generated by a device such as the user device 102. It should be appreciated that the UI diagram illustrated in FIG. 5F is illustrative of one contemplated example of the UIs 110 and therefore should not be construed as being limited in any way. As shown in FIG. 5F, the screen display 500F can be used to present an alert or alarm to a user or other entity at the user device 102. In some embodiments, the alarm or alert can be pushed to the user device 102 at any time. It should be understood that this example is illustrative, and should not be construed as being limiting in any way.

The alert or alarm can be presented at the user device 102 as an alert window 540. The alert window 540 can include one or more descriptions 542 of the alarm or alert conditions present at the monitored location 130. Thus, for example, the alert window 540 can explain that a number of customers at or near a point-of-sale location exceeds a defined threshold, that a number of employees in a break room exceeds a defined threshold, that other defined thresholds are met or exceeded, combinations thereof, or the like. Because other alarm conditions are contemplated and are possible, it should be understood that these examples are illustrative, and should not be construed as being limiting in any way.

The alert window 540 also can include a UI control 544 for launching a presence monitor view at the user device 102 and a UI control 546 for dismissing the alert window 540. Selection of the UI control 544 can cause the user device 102 to generate another UI 110 for viewing the presence monitor. Thus, for example, a user or other entity can interact with the UI 110 shown in FIG. 5F to access a view of the presence information associated with the monitored location, if desired. An example of a view of the presence information is shown in FIG. 5G.

Figure 5G:
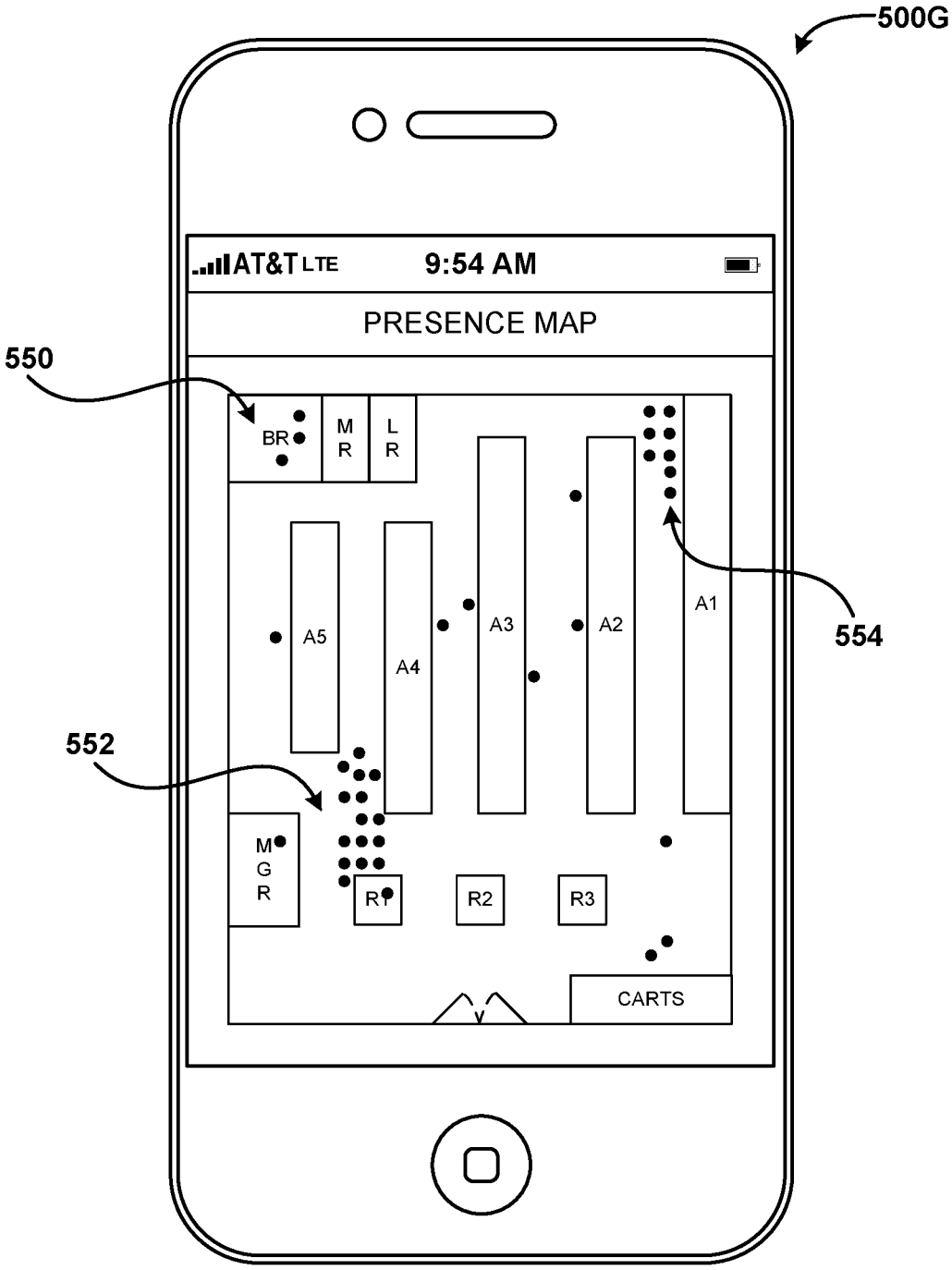

Turning now to FIG. 5G, a UI diagram showing additional aspects of the concepts and technologies disclosed herein for collecting and using presence information are described in detail. In particular, FIG. 5G shows an illustrative screen display 500G generated by a device such as the user device 102. It should be appreciated that the UI diagram illustrated in FIG. 5G is illustrative of one contemplated example of the UIs 110 and therefore should not be construed as being limited in any way. As shown in FIG. 5G, the screen display 500G can be used to present a presence monitor view of a monitored location 130.

In the presence monitor view, a location of each detected person at the monitored location 130 can be represented. Thus, a user or other entity can view the screen display 500G to determine, for example, that three employees are in the break room 550, that a line exists at an area 552 near the only occupied point-of-sale location in the monitored location 130 (based upon the absence of any employees at the other points-of-sale), and that a crowd has formed in an area 554 of the monitored location 130. Based upon this information, the user or other entity can take various actions such as, for example, directing the employees in the break room 550 to exit and to open another point-of-sale, directing an employee, manager, or other entity to investigate the crowd that has formed, or to take other actions. It should be understood that these examples are illustrative, and should not be construed as being limiting in any way.

Figure 6:
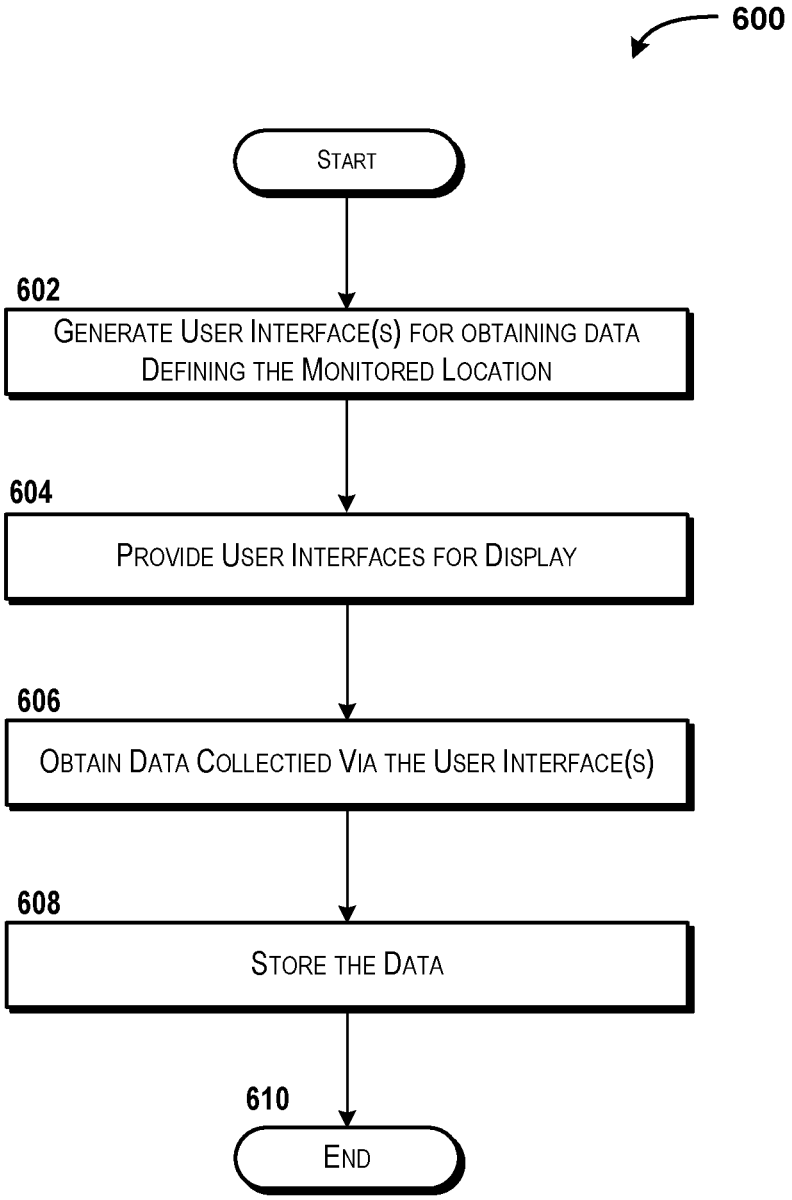
FIG. 6 is a flow diagram showing aspects of a method for obtaining and storing data for providing a presence service, according to an illustrative embodiment.

Turning now to FIG. 6, aspects of a method 600 for obtaining and storing data for providing a presence service will be described in detail, according to an illustrative embodiment. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein.

It also should be understood that the methods disclosed herein can be ended at any time and need not be performed in its entirety. Some or all operations of the methods, and/or substantially equivalent operations, can be performed by execution of computer-readable instructions included on a computer storage media, as defined herein. The term "computer-readable instructions," and variants thereof, as used herein, is used expansively to include routines, applications, application modules, program modules, programs, components, data structures, algorithms, and the like. Computer-readable instructions can be implemented on various system configurations including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These states, operations, structural devices, acts, and modules may be implemented in software, in firmware, in special purpose digital logic, and any combination thereof. As used herein, the phrase "cause a processor to perform operations" and variants thereof is used to refer to causing a processor of a computing system or device, such as the user device 102, the server computer 114, and/or other devices to perform one or more operations and/or causing the processor to direct other components of the computing system or device to perform one or more of the operations.

For purposes of illustrating and describing the concepts of the present disclosure, the method 600 is described as being performed by the server computer 114 via execution of one or more software modules such as, for example, the presence service 116. It should be understood that additional and/or alternative devices and/or network nodes can provide the functionality described herein via execution of one or more modules, applications, and/or other software including, but not limited to, the presence service 116. Thus, the illustrated embodiment is illustrative, and should not be construed as being limiting in any way.

The method 600 begins at operation 602. In operation 602, the server computer 114 generates one or more user interfaces 110 for obtaining data defining a monitored location 130. From the description of FIGS. 1-5G above, it can be appreciated that the server computer 114 can generate, in operation 602, one or more web pages to be rendered by a user device 102 or other computing system, and that the user device 102 can support interactions with the web pages and/or other UIs 110 to create the data in operation 602.

Thus, the data obtained in operation 602 can include, but is not limited to, the data 118 shown in FIG. 1. As such, the data obtained in operation 602 can include, but is not limited to, room data 122, sensor ID data 124, trigger data 126, other data 128, other information, combinations thereof, or the like. It also should be appreciated that multiple UIs 110 may be configured in operation 602, and that multiple UIs 110 may be presented at the user device 102. Thus, while FIG. 6 illustrates a single iteration of operation 602, it should be understood that operation 602 may be repeated any number of times to provide the functionality described herein.

From operation 602, the method 600 proceeds to operation 604, wherein the server computer 114 provides the user interfaces 110 to the user device 102 or other computing system for display. In some embodiments, the server computer 114 provides the user interfaces 110 to the user device 102 or other computing system by hosting the user interfaces 110 and allowing downloads or other transfers of the user interfaces 110. In some other embodiments, the server computer 114 can transmit the data obtained in operation 602 to the user device 102 and/or other computing systems.

From operation 604, the method 600 proceeds to operation 606, wherein the server computer 114 obtains data 118 from the user device 102 or other computing system. It can be appreciated that the data 118 can be obtained by the user device 102, for example, via interactions between users and/or other entities and the UIs 110 generated in operation 602. Thus, in operation 606, the server computer 114 can obtain the data 118 from the user device in response to interactions occurring at the user device 102.

As noted above, the data 118 obtained in operation 606 can include the room data 122, the sensor ID data 124, the trigger data 126, the other data 128, other information, or the like. Thus, the server computer 114 can obtain, in operation 606, data defining the monitored location 130 including data describing the physical layout of the monitored location 130, data describing locations of presence sensors 132 at the monitored location 130 as well as their respective identities, alerts and/or alarm definitions and/or trigger conditions, other information such as historical and/or trend information, combinations thereof, or the like. Thus, the server computer 114 can obtain, in operation 606, data 118 used by the server computer 114 to provide the functionality of the presence service 116 described herein.

In some embodiments, the presence service 116 can generate historical and/or trend information based upon the data 118 and/or presence data 134 obtained over time. Thus, in addition to obtaining data at operation 606, the server computer 114 can generate the data 118 in operation 606 and/or over time. It should be understood that these embodiments are illustrative, and should not be construed as being limiting in any way.

From operation 606, the method 600 proceeds to operation 608, wherein the server computer 114 stores the data 118. As explained above, the server computer 114 can store the data 118 at the data store 120. In some embodiments, the server computer 114 can store the data 118 at other data storage locations such as, for example, a local or remote data storage device, a local or remote server or database, other data storage devices, or the like. The data 118 can be stored at any location and in various embodiments, is accessible to the presence service 116 to provide functionality described herein with reference to various embodiments of the concepts and technologies described herein. Some embodiments of using the data 118 to provide the presence service 116 are described in additional detail below.

From operation 608, the method 600 proceeds to operation 610. The method 600 ends at operation 610.

Figure 7:
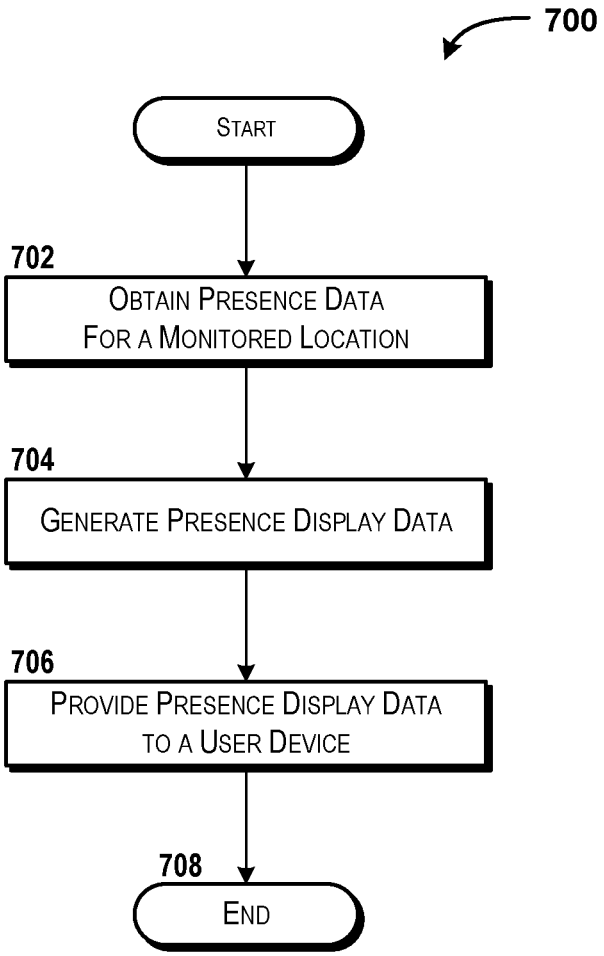
FIG. 7 is a flow diagram showing aspects of a method for obtaining data for providing a presence service, according to another illustrative embodiment.

Turning now to FIG. 7, aspects of a method 700 for obtaining data for providing a presence service will be described in detail, according to an illustrative embodiment. For purposes of illustrating and describing the concepts of the present disclosure, the method 700 is described as being performed by the server computer 114 via execution of one or more software modules such as, for example, the presence service 116. It should be understood that additional and/or alternative devices and/or network nodes can provide the functionality described herein via execution of one or more modules, applications, and/or other software including, but not limited to, the presence service 116. Thus, the illustrated embodiment is illustrative, and should not be viewed as being limiting in any way.

The method 700 begins at operation 702, wherein the server computer 114 obtains presence data 134 associated with a monitored location 130. As explained above in detail, the presence data 134 can include data obtained by one or more receivers or transceivers at, near, or in communication with other devices at or near the monitored location 130. In some embodiments, the presence data 134 can include a list of sensor IDs or identifiers sensed at the monitored location 130. The presence data 134 can be provided as a table or other data structure, if desired. It can be appreciated that by comparing the sensed presence sensors 132 to a list of known presence sensors 132 and their respective identifiers, identities of each responding presence sensor 132 and/or each non-responding presence sensor 132 can be determined. An example of one embodiment of the presence data 134 is provided below in TABLE 1. It should be understood that the example provided in TABLE 1, wherein only six presence sensors 132 are represented, is illustrative and is a simplified example provided solely for purposes of illustrating and describing the concepts and technologies disclosed herein.

TABLE 1

| Sensor ID | Response Time |
|---|---|
| 13f23817-a014-49e1-9bf0-c6734583ad95 | 04/05/13 08:01:37 AM GMT-05:00 |
| 1b9dc08e-90f5-495b-963d-dfbcc1b2660a | 04/05/13 08:01:36 AM GMT-05:00 |
| dbfe7094-fb48-4724-855f-3478496c3594 | 04/05/13 08:01:36 AM GMT-05:00 |
| 36362453-2458-4800-a953-0751a568e58b | 04/05/13 08:01:37 AM GMT-05:00 |
| b6f3c7a2-08ea-41ac-87ce-d02520c8c158 | 04/05/13 08:01:37 AM GMT-05:00 |
| db5f5f85-42f8-4c0c-945e-ad3b1261fa50 | 04/05/13 08:01:37 AM GMT-05:00 |

Similarly, the data 118 can include, among other things, a list of sensor identifiers and corresponding locations within the monitored location 130 of the presence sensors 132, as explained above, particularly with reference to FIGS. 5A-5G. One example of the data 118, and particularly the sensor ID data 124, is provided below in TABLE 2. It should be understood that the example provided in TABLE 2, wherein only nine presence sensors 132 are represented, is illustrative and is a simplified example provided solely for purposes of illustrating and describing the concepts and technologies disclosed herein. Furthermore, the indication of the location of the presence sensors 132 by way of x, y, z coordinates is purely illustrative, and it should be understood that the presence sensors 132 may be located within inches and/or fractions of an inch of one another, depending upon a desired granularity and/or accuracy of the presence service 116.

TABLE 2

| Sensor ID | Location | Sensor Reference |
|---|---|---|
| 13f23817-a014-49e1-9bf0-c6734583ad95 | 0, 0, 0 | A |
| 1b9dc08e-90f5-495b-963d-dfbcc1b2660a | 48, 0, 0 | B |
| dbfe7094-fb48-4724-855f-3478496c3594 | 96, 0, 0 | C |
| 36362453-2458-4800-a953-0751a568e58b | 0, 48, 0 | D |
| a1e46713-85e3-48f1-a781-a9cb9875ade7 | 48, 48, 0 | E |
| 771ecfb3-cc6b-42b7-9e3f-03ac9fa4c356 | 96, 48, 0 | F |
| b6f3c7a2-08ea-41ac-87ce-d02520c8c158 | 0, 96, 0 | G |
| 0126e640-98b5-4747-b88b-a578c8bac58f | 48, 96, 0 | H |
| db5f5f85-42f8-4c0c-945e-ad3b1261fa50 | 96, 96, 0 | I |

By comparing the presence data 134 represented by TABLE 1 above with the sensor ID data 124 represented by TABLE 2, one can appreciate that the presence sensors 132 indicated by the labeled reference characters A, B, C, D, G, and I are present in both the presence data 134 and the sensor ID data 124. Thus, upon receiving the sensor ID data 124 presented in TABLE 2 and comparing the sensor ID data 124 to the presence data 134 in TABLE 1, the presence service 116 or other computing devices or modules can determine that the presence sensors 132 indicated by the labeled reference characters E, F, and H are missing from the presence data 134. Thus, the presence service 116 can determine that these presence sensors 132 are occluded, e.g., blocked by a human body or other object. As explained in detail above, because the location within the monitored location 130 of each presence sensor 132 can be known by the presence service 116, this information can be used to determine presence within the monitored location 130 in an inexpensive, quick, and reliable manner.

From operation 702, the method 700 proceeds to operation 704, wherein the server computer 114 generates presence display data 112. The server computer 114 can use the information determined in operation 702 to generate the presence display data 112. The presence display data 112 can correspond to a web page, an image, or other visual representation of the monitored location 130 and/or people or other entities within the monitored location 130. Various embodiments of UIs 110 for presenting the presence display data 112 have been illustrated and described above with reference to FIGS. 5A-5G and therefore will not be described in additional detail here.

From operation 704, the method 700 proceeds to operation 706, wherein the server computer 114 provides the presence display data 112 to a user device 102 and/or another computing device. The server computer 114 can provide the presence display data 112 by hosting the presence display data 112 as a web page or other hosted data, by transmitting the data to various devices, by supporting downloads or other transfers of the presence display data 112, combinations thereof, or the like. Thus, various computing devices and/or systems can access the presence display data 112 via various embodiments of the concepts and technologies disclosed herein.

From operation 706, the method 700 proceeds to operation 708. The method 700 ends at operation 708.

Figure 8:
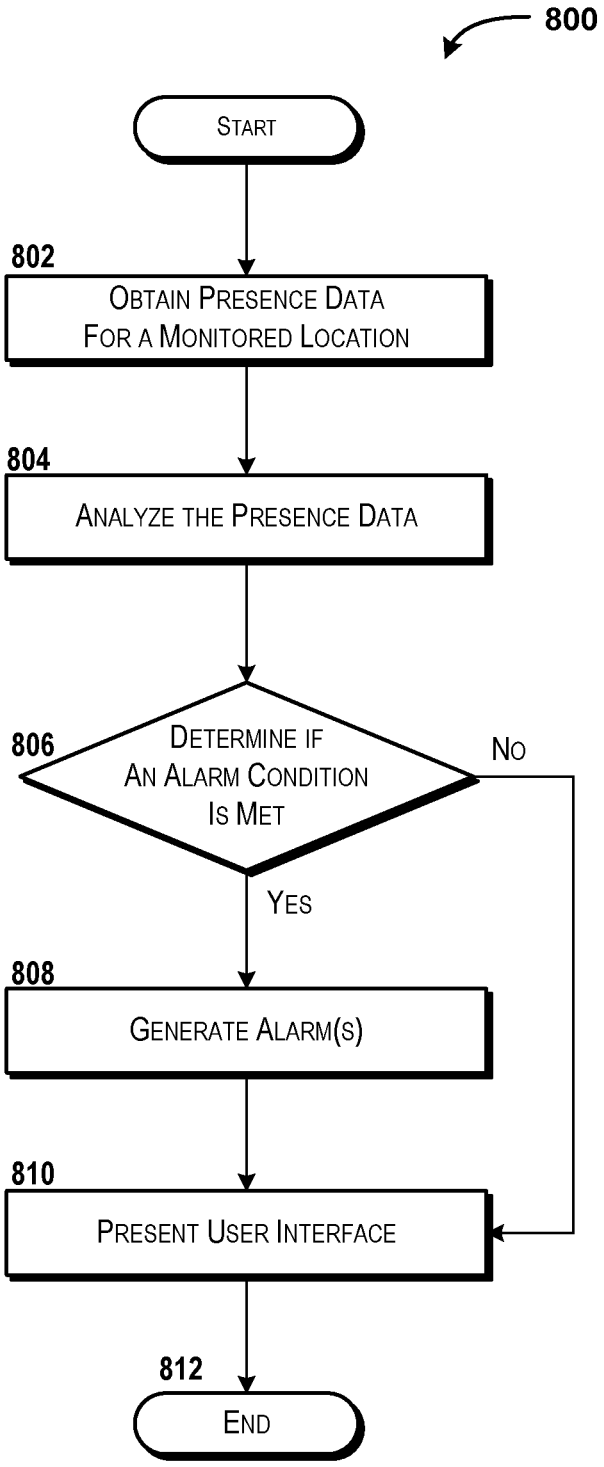
FIG. 8 is a flow diagram showing aspects of a method for presenting data to provide a presence service, according to another illustrative embodiment.

Turning now to FIG. 8, aspects of a method 800 for presenting data to provide a presence service will be described in detail, according to an illustrative embodiment. For purposes of illustrating and describing the concepts of the present disclosure, the method 800 is described as being performed by the user device 102 via execution of one or more software modules such as, for example, the application programs 108. It should be understood that additional and/or alternative devices and/or network nodes can provide the functionality described herein via execution of one or more modules, applications, and/or other software including, but not limited to, the presence service 116. Thus, the illustrated embodiment is illustrative, and should not be viewed as being limiting in any way.

The method 800 begins at operation 802, wherein the user device 102 obtains presence data 134 for a monitored location 130. In some embodiments of the concepts and technologies disclosed herein, the user device 102 can obtain the presence data 134 directly from the monitored location 130 and/or a system or device in communication with the monitored location 130. In some other embodiments, the user device 102 can obtain the presence data 134 via receiving or obtaining the presence display data 112 from the server computer 114 or other device or system. Thus, the user device 102 can obtain the presence data 134 and create the presence display data 112 (not shown in FIG. 8), or obtain the presence display data 112. Thus, the embodiment shown in FIG. 8 should be understood as being illustrative and should not be construed as being limiting in any way.

From operation 802, the method 800 proceeds to operation 804, wherein the user device 102 analyzes the presence data 134. The user device 102 can analyze the presence data 134 to determine presence at the monitored location 130. Thus, as explained above in detail with reference to the presence service 116, the user device 102 can compare the presence data 134 to data 118 and/or other information to determine how to interpret the presence data 134. Thus, the user device 102 can determine presence at the monitored location based upon the presence data 134, the data 118, other information, combinations thereof, or the like.

From operation 804, the method 800 proceeds to operation 806, wherein the user device 102 determines if an alarm condition is met. In particular, the user device 102 can compare the presence determined in operation 804 with one or more alarm or alert conditions. The alarms and/or alert conditions can be stored as, for example, the trigger data 126 shown in FIG. 1. Thus, the user device 102 can be configured to compare the determined presence information to the various triggers and/or other alarm/alert conditions to determine if any alarm condition is met at the monitored location 130. As noted above, the alarm condition can include, for example, a number of people at or near a particular area in the monitored location 130, a line length, a wait time, a total number of people at the monitored location 130, combinations thereof, or the like.

If the user device 102 determines, in operation 806, that an alarm condition exists at the monitored location 130, the method 800 can proceed to operation 808. In operation 808, the user device 102 can generate an alarm or alert at the user device 102 or elsewhere. As discussed above, a user or other entity can configure alarms or alerts as visual alerts, audible alerts, tactile alerts, phone calls, text messages, combinations thereof, or the like. Thus, the user device 102 can generate the alerts (in the case of visual, audible, or tactile alerts, for example) or command or request alerts from other elements or devices.

From operation 808, the method 800 proceeds to operation 810, wherein the user device 102 presents one or more user interfaces such as the UIs 110 described and illustrated above. The user interface presented in operation 810 can present the presence information determined by the user device 102 for various purposes. As shown in FIG. 8, if the user device 102 determines, in operation 806, that no alarm condition is met at the monitored location 130, the method 800 can proceed to operation 810, and the user device 102 can present one or more user interfaces.

From operation 810, the method 800 proceeds to operation 812. The method 800 ends at operation 812.

Figure 9:
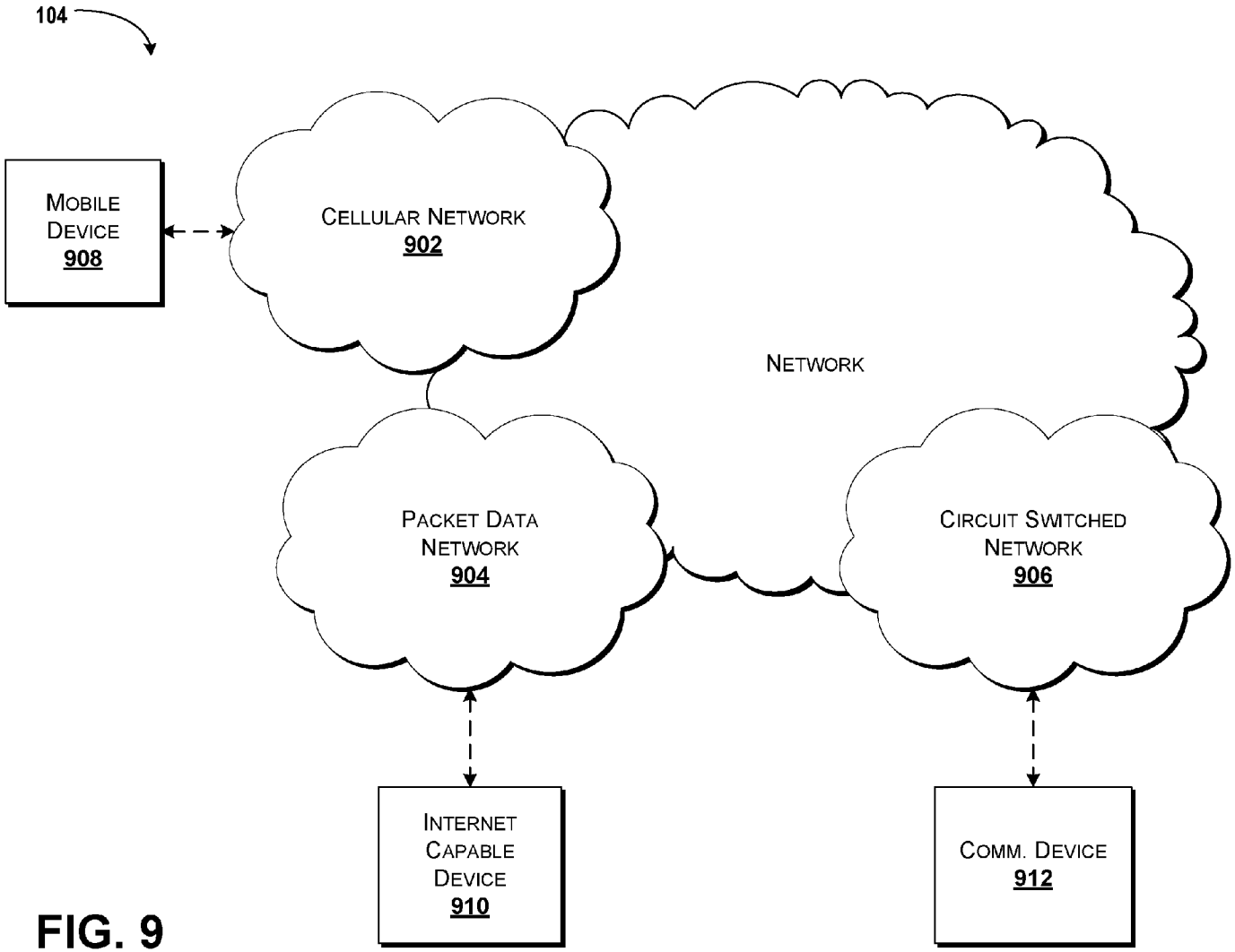
FIG. 9 schematically illustrates a network, according to an illustrative embodiment.

Turning now to FIG. 9, additional details of the network 104 are illustrated, according to an illustrative embodiment. The network 104 includes a cellular network 902, a packet data network 904, for example, the Internet, and a circuit switched network 906, for example, a publicly switched telephone network ("PSTN"). The cellular network 902 includes various components such as, but not limited to, base transceiver stations ("BTSs"), Node-B's or e-Node-B's, base station controllers ("BSCs"), radio network controllers ("RNCs"), mobile switching centers ("MSCs"), mobile management entities ("MMEs"), short message service centers ("SMSCs"), multimedia messaging service centers ("MMSCs"), home location registers ("HLRs"), home subscriber servers ("HSSs"), visitor location registers ("VLRs"), charging platforms, billing platforms, voicemail platforms, GPRS core network components, location service nodes, an IP Multimedia Subsystem ("IMS"), and the like. The cellular network 902 also includes radios and nodes for receiving and transmitting voice, data, and combinations thereof to and from radio transceivers, networks, the packet data network 904, and the circuit switched network 906.

A mobile communications device 908, such as, for example, a cellular telephone, a user equipment, a mobile terminal, a PDA, a laptop computer, a handheld computer, and combinations thereof, can be operatively connected to the cellular network 902. The cellular network 902 can be configured as a 2G GSM network and can provide data communications via GPRS and/or EDGE. Additionally, or alternatively, the cellular network 902 can be configured as a 3G UMTS network and can provide data communications via the HSPA protocol family, for example, HSDPA, EUL (also referred to as HSDPA), and HSPA+. The cellular network 902 also is compatible with 4G mobile communications standards as well as evolved and future mobile standards.

The packet data network 904 includes various devices, for example, servers, computers, databases, and other devices in communication with one another, as is generally known. The packet data network 904 devices are accessible via one or more network links. The servers often store various files that are provided to a requesting device such as, for example, a computer, a terminal, a smartphone, or the like. Typically, the requesting device includes software (a "browser") for executing a web page in a format readable by the browser or other software. Other files and/or data may be accessible via "links" in the retrieved files, as is generally known. In some embodiments, the packet data network 904 includes or is in communication with the Internet. The circuit switched network 906 includes various hardware and software for providing circuit switched communications. The circuit switched network 906 may include, or may be, what is often referred to as a plain old telephone system (POTS). The functionality of a circuit switched network 906 or other circuit-switched network are generally known and will not be described herein in detail.

The illustrated cellular network 902 is shown in communication with the packet data network 904 and a circuit switched network 906, though it should be appreciated that this is not necessarily the case. One or more Internet-capable devices 910, for example, a PC, a laptop, a portable device, or another suitable device, can communicate with one or more cellular networks 902, and devices connected thereto, through the packet data network 904. It also should be appreciated that the Internet-capable device 910 can communicate with the packet data network 904 through the circuit switched network 906, the cellular network 902, and/or via other networks (not illustrated).

As illustrated, a communications device 912, for example, a telephone, facsimile machine, modem, computer, or the like, can be in communication with the circuit switched network 906, and therethrough to the packet data network 904 and/or the cellular network 902. It should be appreciated that the communications device 912 can be an Internet-capable device, and can be substantially similar to the Internet-capable device 910. In the specification, the network 104 is used to refer broadly to any combination of the networks 902, 904, 906. It should be appreciated that substantially all of the functionality described with reference to the network 104 can be performed by the cellular network 902, the packet data network 904, and/or the circuit switched network 906, alone or in combination with other networks, network elements, and the like.

Figure 10:
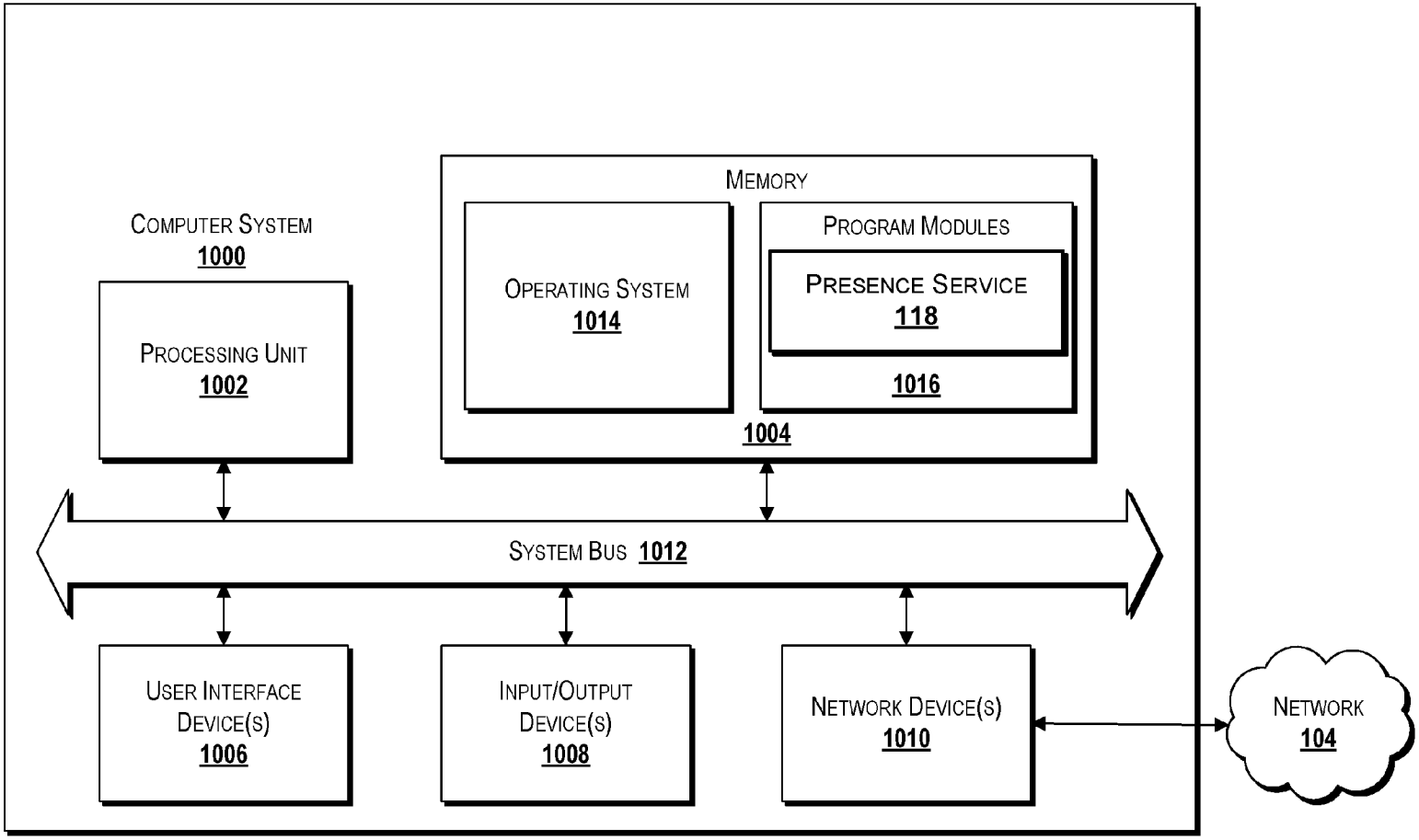
FIG. 10 is a block diagram illustrating an example computer system configured to provide a presence service, according to some illustrative embodiments of the concepts and technologies disclosed herein.

FIG. 10 is a block diagram illustrating a computer system 1000 configured to provide the functionality described herein for providing and/or interacting with a presence sensor network, in accordance with various embodiments of the concepts and technologies disclosed herein. The computer system 1000 includes a processing unit 1002, a memory 1004, one or more user interface devices 1006, one or more input/output ("I/O") devices 1008, and one or more network devices 1010, each of which is operatively connected to a system bus 1012. The bus 1012 enables bi-directional communication between the processing unit 1002, the memory 1004, the user interface devices 1006, the I/O devices 1008, and the network devices 1010.

The processing unit 1002 may be a standard central processor that performs arithmetic and logical operations, a more specific purpose programmable logic controller ("PLC"), a programmable gate array, or other type of processor known to those skilled in the art and suitable for controlling the operation of the server computer. Processing units are generally known, and therefore are not described in further detail herein.

The memory 1004 communicates with the processing unit 1002 via the system bus 1012. In some embodiments, the memory 1004 is operatively connected to a memory controller (not shown) that enables communication with the processing unit 1002 via the system bus 1012. The memory 1004 includes an operating system 1014 and one or more program modules 1016. The operating system 1014 can include, but is not limited to, members of the WINDOWS, WINDOWS CE, and/or WINDOWS MOBILE families of operating systems from MICROSOFT CORPORATION, the LINUX family of operating systems, the SYMBIAN family of operating systems from SYMBIAN LIMITED, the BREW family of operating systems from QUALCOMM CORPORATION, the MAC OS, iOS, and/or LEOPARD families of operating systems from APPLE CORPORATION, the FREEBSD family of operating systems, the SOLARIS family of operating systems from ORACLE CORPORATION, other operating systems, and the like.

The program modules 1016 may include various software and/or program modules described herein. In some embodiments, for example, the program modules 1016 include the presence service 116. This and/or other programs can be embodied in computer-readable media containing instructions that, when executed by the processing unit 1002, perform one or more operations of the methods 600-800 described in detail above with respect to FIGS. 6-8. According to embodiments, the program modules 1016 may be embodied in hardware, software, firmware, or any combination thereof. Although not shown in FIG. 10, it should be understood that the memory 1004 also can be configured to store the presence display data 112, the data 118, the presence data 134, and/or other data, if desired.

By way of example, and not limitation, computer-readable media may include any available computer storage media or communication media that can be accessed by the computer system 1000. Communication media includes computer-readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Computer storage media includes volatile and non-volatile, removable and non-removable media implemented in any method or technology for storage of information such as computer-readable instructions, data structures, program modules, or other data. Computer storage media includes, but is not limited to, RAM, ROM, Erasable Programmable ROM ("EPROM"), Electrically Erasable Programmable ROM ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer system 1000. In the claims, the phrase "computer storage medium" and variations thereof does not include waves or signals per se and/or communication media as defined herein.

The user interface devices 1006 may include one or more devices with which a user accesses the computer system 1000. The user interface devices 1006 may include, but are not limited to, computers, servers, personal digital assistants, cellular phones, or any suitable computing devices. The I/O devices 1008 enable a user to interface with the program modules 1016. In one embodiment, the I/O devices 1008 are operatively connected to an I/O controller (not shown) that enables communication with the processing unit 1002 via the system bus 1012. The I/O devices 1008 may include one or more input devices, such as, but not limited to, a keyboard, a mouse, or an electronic stylus. Further, the I/O devices 1008 may include one or more output devices, such as, but not limited to, a display screen or a printer.

The network devices 1010 enable the computer system 1000 to communicate with other networks or remote systems via a network, such as the network 104. Examples of the network devices 1010 include, but are not limited to, a modem, a radio frequency ("RF") or infrared ("IR") transceiver, a telephonic interface, a bridge, a router, or a network card. The network 104 may include a wireless network such as, but not limited to, a Wireless Local Area Network ("WLAN") such as a WI-FI network, a Wireless Wide Area Network ("WWAN"), a Wireless Personal Area Network ("WPAN") such as BLUETOOTH, a Wireless Metropolitan Area Network ("WMAN") such a WiMAX network, or a cellular network. Alternatively, the network 104 may be a wired network such as, but not limited to, a Wide Area Network ("WAN") such as the Internet, a Local Area Network ("LAN") such as the Ethernet, a wired Personal Area Network ("PAN"), or a wired Metropolitan Area Network ("MAN").

Figure 11:
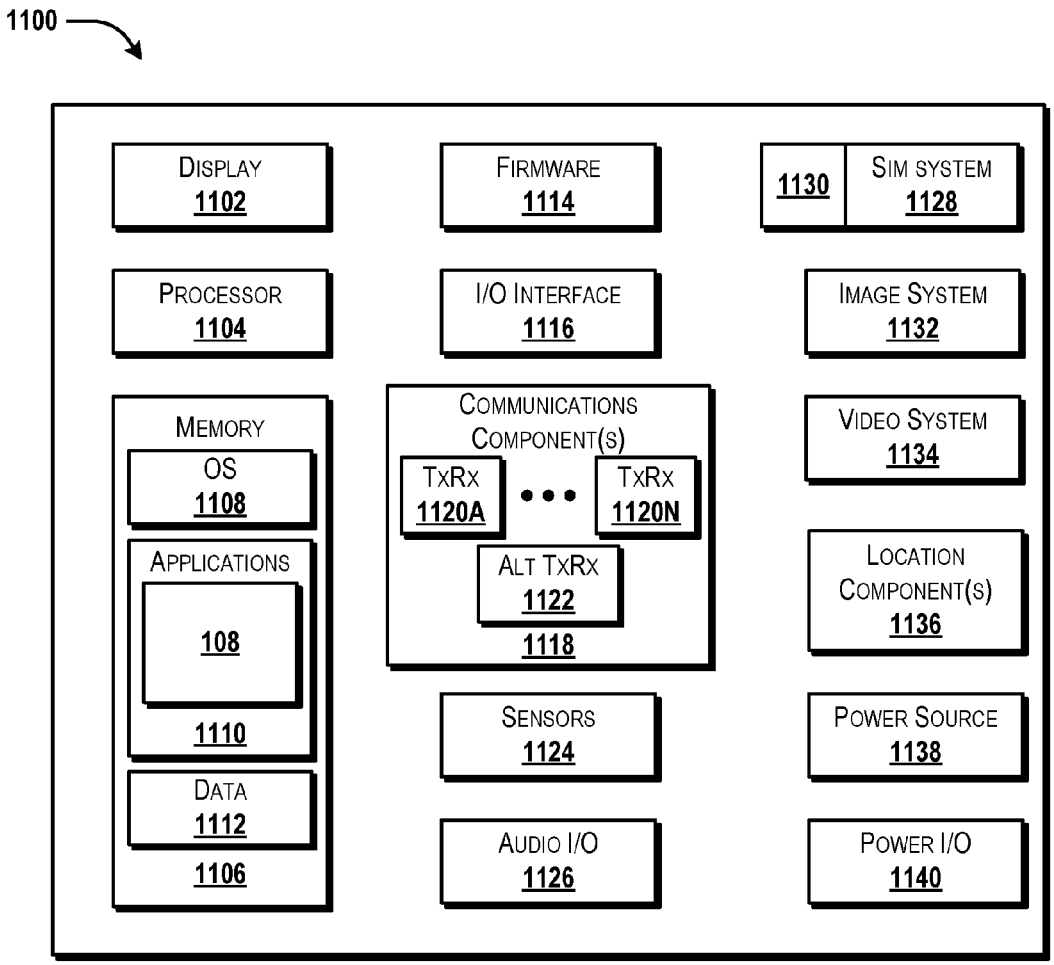
FIG. 11 is a block diagram illustrating an example mobile device configured to interact with a presence service, according to some illustrative embodiments.

Turning now to FIG. 11, an illustrative mobile device 1100 and components thereof will be described. In some embodiments, the user device 102 described above with reference to FIGS. 1-10 can be configured as and/or can have an architecture similar or identical to the mobile device 1100 described herein in FIG. 11. It should be understood, however, that the user device 102 may or may not include the functionality described herein with reference to FIG. 11. While connections are not shown between the various components illustrated in FIG. 11, it should be understood that some, none, or all of the components illustrated in FIG. 11 can be configured to interact with one other to carry out various device functions. In some embodiments, the components are arranged so as to communicate via one or more busses (not shown). Thus, it should be understood that FIG. 11 and the following description are intended to provide a general understanding of a suitable environment in which various aspects of embodiments can be implemented, and should not be construed as being limiting in any way.

As illustrated in FIG. 11, the mobile device 1100 can include a display 1102 for displaying data. According to various embodiments, the display 1102 can be configured to display asset information, asset tag or asset ID information, asset management account information, various graphical user interface ("GUI") elements, text, images, video, virtual keypads and/or keyboards, messaging data, notification messages, metadata, internet content, device status, time, date, calendar data, device preferences, map and location data, combinations thereof, and/or the like. The mobile device 1100 also can include a processor 1104 and a memory or other data storage device ("memory") 1106. The processor 1104 can be configured to process data and/or can execute computer-executable instructions stored in the memory 1106. The computer-executable instructions executed by the processor 1104 can include, for example, an operating system 1108, one or more applications 1110 such as the application programs 108, other computer-executable instructions stored in a memory 1106, or the like. In some embodiments, the applications 1110 also can include a UI application (not illustrated in FIG. 11).

The UI application can interface with the operating system 1108, such as the operating system 106 shown in FIG. 1, to facilitate user interaction with functionality and/or data stored at the mobile device 1100 and/or stored elsewhere. In some embodiments, the operating system 1108 can include a member of the SYMBIAN OS family of operating systems from SYMBIAN LIMITED, a member of the WINDOWS MOBILE OS and/or WINDOWS PHONE OS families of operating systems from MICROSOFT CORPORATION, a member of the PALM WEBOS family of operating systems from HEWLETT PACKARD CORPORATION, a member of the BLACKBERRY OS family of operating systems from RESEARCH IN MOTION LIMITED, a member of the IOS family of operating systems from APPLE INC., a member of the ANDROID OS family of operating systems from GOOGLE INC., and/or other operating systems. These operating systems are merely illustrative of some contemplated operating systems that may be used in accordance with various embodiments of the concepts and technologies described herein and therefore should not be construed as being limiting in any way.

The UI application can be executed by the processor 1104 to aid a user in entering content, scanning or capturing asset ID or asset tag information, creating new asset tags or asset ID numbers, viewing asset information and/or account information, answering/initiating calls, entering/deleting data, entering and setting user IDs and passwords for device access, configuring settings, manipulating address book content and/or settings, multimode interaction, interacting with other applications 1110, and otherwise facilitating user interaction with the operating system 1108, the applications 1110, and/or other types or instances of data 1112 that can be stored at the mobile device 1100. The data 1112 can include, for example, asset information, asset tags and/or asset identifiers, and/or other applications or program modules. According to various embodiments, the data 1112 can include, for example, presence applications, visual voice mail applications, messaging applications, text-to-speech and speech-to-text applications, add-ons, plug-ins, email applications, music applications, video applications, camera applications, location-based service applications, power conservation applications, game applications, productivity applications, entertainment applications, enterprise applications, combinations thereof, and the like. The applications 1110, the data 1112, and/or portions thereof can be stored in the memory 1106 and/or in a firmware 1114, and can be executed by the processor 1104. The firmware 1114 also can store code for execution during device power up and power down operations. It can be appreciated that the firmware 1114 can be stored in a volatile or non-volatile data storage device including, but not limited to, the memory 1106 and/or a portion thereof.

The mobile device 1100 also can include an input/output ("I/O") interface 1116. The I/O interface 1116 can be configured to support the input/output of data such as location information, asset information, user information, organization information, presence status information, user IDs, passwords, and application initiation (start-up) requests. In some embodiments, the I/O interface 1116 can include a hardwire connection such as a universal serial bus ("USB") port, a mini-USB port, a micro-USB port, an audio jack, a PS2 port, an IEEE 1394 ("FIREWIRE") port, a serial port, a parallel port, an Ethernet (RJ45) port, an RJ11 port, a proprietary port, combinations thereof, or the like. In some embodiments, the mobile device 1100 can be configured to synchronize with another device to transfer content to and/or from the mobile device 1100. In some embodiments, the mobile device 1100 can be configured to receive updates to one or more of the applications 1110 via the I/O interface 1116, though this is not necessarily the case. In some embodiments, the I/O interface 1116 accepts I/O devices such as keyboards, keypads, mice, interface tethers, printers, plotters, external storage, touch/multi-touch screens, touch pads, trackballs, joysticks, microphones, remote control devices, displays, projectors, medical equipment (e.g., stethoscopes, heart monitors, and other health metric monitors), modems, routers, external power sources, docking stations, combinations thereof, and the like. It should be appreciated that the I/O interface 1116 may be used for communications between the mobile device 1100 and a network device or local device.

The mobile device 1100 also can include a communications component 1118. The communications component 1118 can be configured to interface with the processor 1104 to facilitate wired and/or wireless communications with one or more networks such as the network 104 described herein. In some embodiments, other networks include networks that utilize non-cellular wireless technologies such as WI-FI or WIMAX. In some embodiments, the communications component 1118 includes a multimode communications subsystem for facilitating communications via the cellular network and one or more other networks.

The communications component 1118, in some embodiments, includes one or more transceivers. The one or more transceivers, if included, can be configured to communicate over the same and/or different wireless technology standards with respect to one another. For example, in some embodiments one or more of the transceivers of the communications component 1118 may be configured to communicate using GSM, CDMAONE, CDMA2000, LTE, and various other 2G, 2.5G, 3G, 4G, and greater generation technology standards. Moreover, the communications component 1118 may facilitate communications over various channel access methods (which may or may not be used by the aforementioned standards) including, but not limited to, TDMA, FDMA, W-CDMA, OFDM, SDMA, and the like.

In addition, the communications component 1118 may facilitate data communications using GPRS, EDGE, the HSPA protocol family including HSDPA, EUL or otherwise termed HSDPA, HSPA+, and various other current and future wireless data access standards. In the illustrated embodiment, the communications component 1118 can include a first transceiver ("TxRx") 1120A that can operate in a first communications mode (e.g., GSM). The communications component 1118 also can include an $N^{th}$ transceiver ("TxRx") 1120N that can operate in a second communications mode relative to the first transceiver 1120A (e.g., UMTS). While two transceivers 1120A-N (hereinafter collectively and/or generically referred to as "transceivers 1120") are shown in FIG. 11, it should be appreciated that less than two, two, and/or more than two transceivers 1120 can be included in the communications component 1118.

The communications component 1118 also can include an alternative transceiver ("Alt TxRx") 1122 for supporting other types and/or standards of communications. According to various contemplated embodiments, the alternative transceiver 1122 can communicate using various communications technologies such as, for example, WI-FI, WIMAX, BLUETOOTH, infrared, infrared data association ("IRDA"), near field communications ("NFC"), other RF technologies, combinations thereof, and the like. In some embodiments, the communications component 1118 also can facilitate reception from terrestrial radio networks, digital satellite radio networks, internet-based radio service networks, combinations thereof, and the like. The communications component 1118 can process data from a network such as the Internet, an intranet, a broadband network, a WI-FI hotspot, an Internet service provider ("ISP"), a digital subscriber line ("DSL") provider, a broadband provider, combinations thereof, or the like.

The mobile device 1100 also can include one or more sensors 1124. The sensors 1124 can include temperature sensors, light sensors, air quality sensors, movement sensors, orientation sensors, noise sensors, proximity sensors, or the like. As such, it should be understood that the sensors 1124 can include, but are not limited to, accelerometers, magnetometers, gyroscopes, infrared sensors, noise sensors, microphones, combinations thereof, or the like. Additionally, audio capabilities for the mobile device 1100 may be provided by an audio I/O component 1126. The audio I/O component 1126 of the mobile device 1100 can include one or more speakers for the output of audio signals, one or more microphones for the collection and/or input of audio signals, and/or other audio input and/or output devices.

The illustrated mobile device 1100 also can include a subscriber identity module ("SIM") system 1128. The SIM system 1128 can include a universal SIM ("USIM"), a universal integrated circuit card ("UICC") and/or other identity devices. The SIM system 1128 can include and/or can be connected to or inserted into an interface such as a slot interface 1130. In some embodiments, the slot interface 1130 can be configured to accept insertion of other identity cards or modules for accessing various types of networks. Additionally, or alternatively, the slot interface 1130 can be configured to accept multiple subscriber identity cards. Because other devices and/or modules for identifying users and/or the mobile device 1100 are contemplated, it should be understood that these embodiments are illustrative, and should not be construed as being limiting in any way.

The mobile device 1100 also can include an image capture and processing system 1132 ("image system"). The image system 1132 can be configured to capture or otherwise obtain photos, videos, and/or other visual information. As such, the image system 1132 can include cameras, lenses, charge-coupled devices ("CCDs"), combinations thereof, or the like. The mobile device 1100 may also include a video system 1134. The video system 1134 can be configured to capture, process, record, modify, and/or store video content. Photos and videos obtained using the image system 1132 and the video system 1134, respectively, may be added as message content to an MMS message, email message, and sent to another mobile device. The video and/or photo content also can be shared with other devices via various types of data transfers via wired and/or wireless communication devices as described herein.

The mobile device 1100 also can include one or more location components 1136. The location components 1136 can be configured to send and/or receive signals to determine a geographic location of the mobile device 1100. According to various embodiments, the location components 1136 can send and/or receive signals from global positioning system ("GPS") devices, assisted-GPS ("A-GPS") devices, WI-FI/WIMAX and/or cellular network triangulation data, combinations thereof, and the like. The location component 1136 also can be configured to communicate with the communications component 1118 to retrieve triangulation data for determining a location of the mobile device 1100. In some embodiments, the location component 1136 can interface with cellular network nodes, telephone lines, satellites, location transmitters and/or beacons, wireless network transmitters and receivers, combinations thereof, and the like. In some embodiments, the location component 1136 can include and/or can communicate with one or more of the sensors 1124 such as a compass, an accelerometer, and/or a gyroscope to determine the orientation of the mobile device 1100. Using the location component 1136, the mobile device 1100 can generate and/or receive data to identify its geographic location, or to transmit data used by other devices to determine the location of the mobile device 1100. The location component 1136 may include multiple components for determining the location and/or orientation of the mobile device 1100.

The illustrated mobile device 1100 also can include a power source 1138. The power source 1138 can include one or more batteries, power supplies, power cells, and/or other power subsystems including alternating current ("AC") and/or direct current ("DC") power devices. The power source 1138 also can interface with an external power system or charging equipment via a power I/O component 1140.

Because the mobile device 1100 can include additional and/or alternative components, the above embodiment should be understood as being illustrative of one possible operating environment for various embodiments of the concepts and technologies described herein. The described embodiment of the mobile device 1100 is illustrative, and should not be construed as being limiting in any way.

Based on the foregoing, it should be appreciated that systems and methods detecting presence using a presence sensor network have been disclosed herein. Although the subject matter presented herein has been described in language specific to computer structural features, methodological and transformative acts, specific computing machinery, and computer-readable media, it is to be understood that the concepts and technologies disclosed herein are not necessarily limited to the specific features, acts, or media described herein. Rather, the specific features, acts and mediums are disclosed as example forms of implementing the concepts and technologies disclosed herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

We claim:

1. A method comprising:

obtaining, at a processor that executes a presence service, sensor identifier data that identifies a presence sensor that is located at a monitored location, the sensor identifier data comprising a first unique identifier associated with the presence sensor and data that defines a location of the presence sensor at the monitored location;

storing, by the processor, the sensor identifier data;

obtaining, by the processor, presence data associated with the monitored location, the presence data comprising a plurality of unique identifiers associated with a plurality of presence sensors located at the monitored location;

comparing, by the processor, the first unique identifier to the presence data; and determining, by the processor, that an object is located at the monitored location in response to a determination that the first unique identifier is not included in the presence data.

2. The method of claim 1, further comprising triggering an alarm in response to a determination that an alarm condition exists at the monitored location.

3. The method of claim 2, further comprising pushing, directed to a user device, an alert that comprises an indication that the alarm condition exists.

4. The method of claim 1, further comprising:

generating presence display data based upon the presence data and the sensor identifier data.

5. The method of claim 4, wherein the presence data is obtained via a receiver located at the monitored location, and wherein the receiver obtains the plurality of unique identifiers from a plurality of radio frequency identification tags located at the monitored location.

6. The method of claim 1, further comprising obtaining trigger data that defines alarm conditions, and preferences that define how alerts are delivered.

7. The method of claim 1, further comprising:

generating historical data that defines presence at the monitored location, and trend data that defines a trend associated with the presence at the monitored location.

8. A system comprising:

a processor; and a memory that stores computer-executable instructions that, when executed by the processor, cause the processor to perform operations comprising obtaining sensor identifier data that identifies a presence sensor that is located at a monitored location, the sensor identifier data comprising a first unique identifier associated with the presence sensor and data that defines a location of the presence sensor at the monitored location, storing the sensor identifier data, obtaining presence data associated with the monitored location, the presence data comprising a plurality of unique identifiers associated with a plurality of presence sensors located at the monitored location, comparing the first unique identifier to the presence data, and determining that an object is located at the monitored location in response to a determination that the first unique identifier is not included in the presence data.

9. The system of claim 8, wherein the computer-executable instructions, when executed by the processor, cause the processor to perform operations further comprising:

triggering an alarm in response to a determination that an alarm condition exists at the monitored location.

10. The system of claim 9, wherein the computer-executable instructions, when executed by the processor, cause the processor to perform operations further comprising:

pushing, directed to a user device, an alert that comprises an indication that the alarm condition exists.

11. The system of claim 8, wherein the computer-executable instructions, when executed by the processor, cause the processor to perform operations further comprising:

generating presence display data based upon the presence data and the sensor identifier data.

12. The system of claim 11, wherein the presence data is obtained via a receiver located at the monitored location, and wherein the receiver obtains the plurality of unique identifiers from a plurality of radio frequency identification tags located at the monitored location.

13. The system of claim 8, wherein the computer-executable instructions, when executed by the processor, cause the processor to perform operations further comprising:

obtaining trigger data that defines alarm conditions, and preferences that define how alerts are delivered.

14. The system of claim 8, wherein the computer-executable instructions, when executed by the processor, cause the processor to perform operations further comprising:

generating historical data that defines presence at the monitored location, and trend data that defines a trend associated with the presence at the monitored location.

15. A computer storage medium having computer-executable instructions stored thereon that, when executed by a processor, cause the processor to perform operations comprising:

obtaining sensor identifier data that identifies a presence sensor that is located at a monitored location, the sensor identifier data comprising a first unique identifier associated with the presence sensor and data that defines a location of the presence sensor at the monitored location;

storing the sensor identifier data;

obtaining presence data associated with the monitored location, the presence data comprising a plurality of unique identifiers associated with a plurality of presence sensors located at the monitored location;

comparing the first unique identifier to the presence data; and determining that an object is located at the monitored location in response to a determination that the first unique identifier is not included in the presence data.

16. The computer storage medium of claim 15, wherein the computer-executable instructions, when executed by the processor, cause the processor to perform operations further comprising:

triggering an alarm in response to a determination that an alarm condition exists at the monitored location.

17. The computer storage medium of claim 16, wherein the computer-executable instructions, when executed by the processor, cause the processor to perform operations further comprising:

pushing, directed to a user device, an alert that comprises an indication that the alarm condition exists.

18. The computer storage medium of claim 15, wherein the computer-executable instructions, when executed by the processor, cause the processor to perform operations further comprising:

generating presence display data based upon the presence data and the sensor identifier data.

19. The computer storage medium of claim 18, wherein the presence data is obtained via a receiver located at the monitored location, and wherein the receiver obtains the plurality of unique identifiers from a plurality of radio frequency identification tags located at the monitored location.

20. The computer storage medium of claim 15, wherein the computer-executable instructions, when executed by the processor, cause the processor to perform operations further comprising:

obtaining trigger data that defines alarm conditions, and preferences that define how alerts are delivered.

* * * * *